US007525518B2

(12) United States Patent
Sagano et al.

(10) Patent No.: US 7,525,518 B2
(45) Date of Patent: Apr. 28, 2009

(54) IMAGE DISPLAY APPARATUS

(75) Inventors: Osamu Sagano, Tokyo (JP); Hiroshi Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 753 days.

(21) Appl. No.: 10/743,871

(22) Filed: Dec. 24, 2003

(65) Prior Publication Data

US 2004/0165004 A1 Aug. 26, 2004

(30) Foreign Application Priority Data

Dec. 27, 2002 (JP) ..... 2002-380617

(51) Int. Cl.
*G09G 3/20* (2006.01)

(52) U.S. Cl. ..... 345/75.2; 345/74.1

(58) Field of Classification Search ..... 345/76–102, 345/74.1, 75.1, 75.2, 211, 690
See application file for complete search history.

(56) References Cited

U.S. PATENT DOCUMENTS

| | | | | |
|---|---|---|---|---|
| 5,555,000 | A * | 9/1996 | Sarrasin et al. | 345/75.2 |
| 5,734,361 | A * | 3/1998 | Suzuki et al. | 345/74.1 |
| 6,515,641 | B1 | 2/2003 | Sagano et al. | 345/76 |
| 6,580,407 | B1 | 6/2003 | Suzuki et al. | 345/74.1 |
| 2002/0089473 | A1 | 7/2002 | Yamazaki et al. | 345/75.2 |
| 2003/0011545 | A1 | 1/2003 | Sagano et al. | 345/76 |
| 2003/0016195 | A1 | 1/2003 | Sagano et al. | 345/75.2 |

FOREIGN PATENT DOCUMENTS

| | | |
|---|---|---|
| JP | 8-248920 | 9/1996 |
| JP | 8-248921 | 9/1996 |
| JP | 10-207424 | 8/1998 |
| JP | 2001-109421 | 4/2001 |
| JP | 2002-229506 | 8/2002 |
| JP | 2002-311885 | 10/2002 |
| WO | WO 97/33271 | 9/1997 |

* cited by examiner

*Primary Examiner*—Duc Q Dinh
(74) *Attorney, Agent, or Firm*—Fitzpatrick, Cella, Harper & Scinto

(57) ABSTRACT

An image display apparatus includes an image display devices driven in a matrix by a plurality of row wirings and column wirings, a scanning circuit for sequentially selecting and scanning the row wirings, a modulation circuit for applying a modulated signal, voltage amplitude of which varies in one pulse signal, to the column wirings, and a voltage drop compensation circuit for calculating corrected image data for reducing an influence of voltage drops due to at least resistance components of the row wirings, with respect to image data. The voltage drop compensation circuit include an effective voltage calculating circuit for finding an effective voltage value on the basis of the image data, and a compensation value calculating circuit for calculating a compensation value for reducing an influence of voltage drops due to at least resistance components of the row wirings, with respect to the effective voltage value. The modulation circuit outputs a modulated signal, a voltage amplitude of which varies in one pulse signal, on the basis of the corrected image data.

5 Claims, 21 Drawing Sheets

IMAGE DISPLAY APPARATUS

BACKGROUND OF THE INVENTION

The present invention relates to an image display apparatus provided with a display panel in which a plurality of display devices are connected to one another by matrix wiring.

RELATED BACKGROUND ART

This kind of related art image display apparatus is disclosed in, for example, JP-A-8-248920. In this image display apparatus, a total of N×M cold cathode devices (N devices are arrayed in the row direction of a matrix and M devices are arrayed in the column direction of the same) are two-dimensionally arranged in matrix form, and the image display apparatus has multiple cathodes which include the N×M cold cathode devices connected to one another by matrix wiring with M-number of row wirings provided in the row direction and N-number of column wirings provided in the column direction (passive matrix structure).

In this image display apparatus, predetermined driving voltages are applied to both the row wirings and the column wirings to drive the cold cathode devices connected to both wirings to emit electrons, and electron beams are irradiated onto phosphors disposed in opposition to the multiple cathodes, thereby displaying an image.

In the case where a multiplicity of cold cathode devices connected by matrix wiring are to be driven, a method of driving a group of devices for one row of the matrix at the same time (a group of devices for one row are connected to one row wiring) is carried out.

Namely, a predetermined selecting potential is applied to one row wiring, while predetermined modulated potentials are respectively applied to only column wirings which are connected to driving targets among N-number of cold cathode devices connected to the one row wiring, whereby a plurality of devices for one row are controlled at the same time. Subsequently, all the rows are scanned in such a way that driving is switched from row to row, whereby a two-dimensional image is formed by making use of the afterimage phenomenon of vision (line sequential driving).

As compared with a method of performing scanning on a device-by-device basis, this method has the advantage that driving time to be allotted for each device can be made N times as long, whereby the luminance of the image display apparatus can be made high.

However, the N-number of cold cathode devices for one row are connected to one row wiring, and the respective cold cathode devices are connected to different positions of the one row wiring. For this reason, when cold cathode devices for one row are driven at the same time, the luminances of the individual devices become non-uniform under the influence of voltage drops due to wiring resistance.

These voltage drops are particularly remarkable in a selected row wiring into which a concentrated current flows during line sequential driving.

In addition, such a voltage drop is varied not only by a resistance value from a driving end of the row wiring to the position of the voltage drop, but also according to at which position a cold cathode device in a driven state is located. Accordingly, when compensation is to be performed, it is necessary to perform compensation according to image data.

To compensate for a luminance decrease caused by the voltage drop, JP-A-8-248920 discloses a construction which calculates the quantity of correction of image data and synthesizes the quantity of correction and the image data.

The related art construction will be described below with reference to FIG. 16. FIG. 16 shows the construction diagram of a second embodiment of JP-A-8-248920. Although the detailed description provided in JP-A-8-248920 is omitted herein, the second embodiment of JP-A-8-248920 discloses a construction in which, as shown in FIG. 16, multipliers 208 which are respectively provided on column wirings multiply luminance data by correction data supplied from memory means 207 and transfer corrected data to a modulated signal generator 209 for the purpose of correction.

In addition, the present inventor discloses in JP-A-2002-229506 an example which suitably compensates for the influence of voltage drops by means of a more simple circuit construction. Although the detailed description provided in JP-A-2002-229506 is omitted herein, JP-A-2002-229506 discloses an image display apparatus which performs line sequential scanning of its display panel having wirings connected in matrix form. Furthermore, there is disclosed a construction which calculates and compensates for the quantities of voltage drops occurring in scanning wirings when modulation is being performed by means of voltage-amplitude modulation, through a reduced number of circuits.

JP-A-2002-229506 also has a description referring to a method of dividing the length of a scanning wiring into a plurality of blocks before the calculation of voltage drop quantities, calculating the voltage drop quantities of the respective blocks from the states of lighting of the respective blocks, and correcting the waveforms of driving pulses to be applied to a respective plurality of column wirings, by interpolating the voltage drop quantities of the respective blocks.

The present inventors have made further investigations and have discovered that a modulation method using both modulation of pulses in the voltage direction and modulation of pulses in the time direction as shown in FIG. 17 is preferable as a modulation method (modulated pulses) for modulating a display panel.

The reason for this is as follows:

(1) If a preferable number of gray scale levels for displaying an image are to be represented, the use of simple pulse-width modulation makes the clock frequency of pulse-width modulation excessively high; and (2) If a preferable number of gray scale levels for displaying an image are to be represented, the use of simple amplitude modulation increases the number of bits of a D/A conversion circuit, so that the circuit scale becomes large.

However, investigations have not yet been made as to a method of compensating for the influence of the above-described voltage drops according to gray scale information on image data in the modulation method using both modulation of modulated pulses in the voltage direction and modulation of modulated pulses in the time direction.

Satisfactory investigations have not yet been made as to: in what order modulated pulses are to be increased in the above-described modulation method when input data for modulation means are increased for the purpose of compensating for voltage drops and suitably displaying an image.

SUMMARY OF THE INVENTION

An object of the invention is to provide an art which suitably compensates for the influence of voltage drops and obtains a preferable display image by using a modulation method employing both modulation of pulse width in the voltage direction and modulation of pulse width in the time direction.

Another object of the invention is to provide an image display apparatus which comprises:

image display devices arranged in matrix form, driven via a plurality of row wirings and column wirings, and used for forming an image;

scanning means for sequentially selecting and scanning the row wirings;

modulation means for outputting a modulated signal to be applied to the column wirings; and voltage drop compensation means for calculating corrected image data for reducing an influence of voltage drops due to at least resistance components of the row wirings, with respect to image data, wherein the modulated signal is a pulse-width modulated voltage signal having a plurality of voltage amplitude values, the modulation means output a modulated signal in which a pulse width and/or a voltage amplitude value of the modulated signal are expanded on the basis of the corrected image data.

DETAILED DESCRIPTION OF THE PREFERRED EMBODIMENTS

Preferred embodiments of the invention will be illustratively described below in detail with reference to the accompanying drawings. In the following description, unless otherwise specified, the scope of the invention is not to be construed to be limited to specific factors such as dimensions, materials, shapes or relative arrangements of individual constituent components of embodiments which will be described below.

First Embodiment

As described above, an image display apparatus in which image display devices such as surface conduction electron-emitting devices are arranged in the form of a passive matrix structure has the problem that a display image is degraded by the influence of voltage drops on row wirings.

The first embodiment aims to suitably compensate for the influence of voltage drops due to wiring resistance in an image display apparatus employing a modulation system which modulates the voltage direction and the time direction of pulse width (amplitude and pulse-width modulations).

Figure 2:
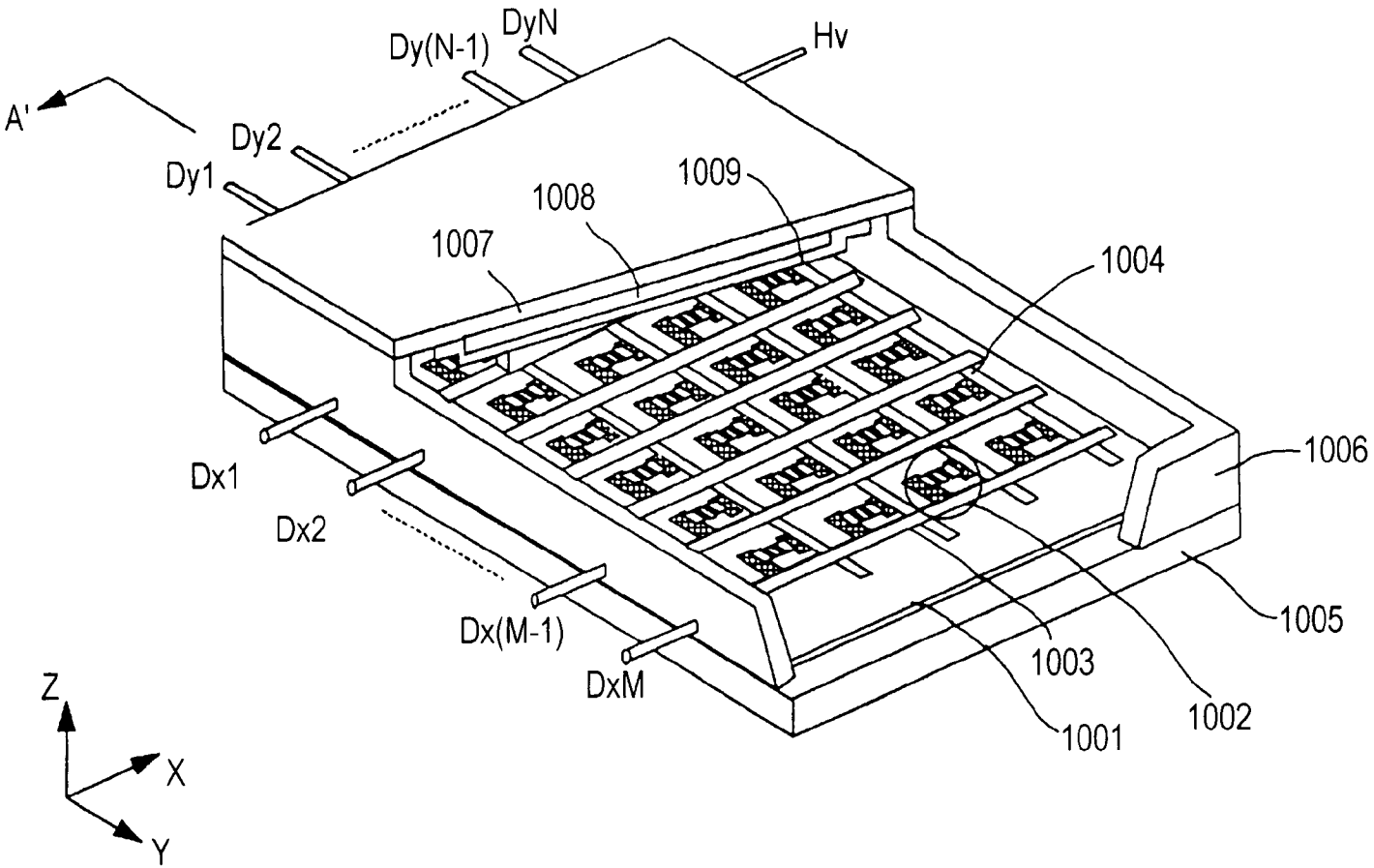
FIG. 2 is a perspective view of a display panel used in the image display apparatus according to the first embodiment.

The general view and the electrical connection of a display panel which is an image display apparatus according to the invention are based on the construction described in JP-A-2002-229506, that is to say, a structure in which row wirings and column wirings are arranged in the form of a so-called passive matrix and image display devices are respectively disposed at the intersections of the row wirings and the column wirings (refer to FIG. 2).

The characteristics of a surface conduction electron-emitting device which can be suitably used as one example of an image display device for the image display apparatus according to the invention will be described below.

(Characteristics of Surface Conduction Electron-Emitting Device)

The surface conduction electron-emitting device includes two electrodes and an electron-emitting part formed therebetween. As shown in FIG. 2, the two electrodes are respectively connected to a row wiring 1003 and a column wiring 1004, and when a predetermined voltage is applied across both electrodes (the potential difference is a device driving voltage Vf), electrons are emitted from the electron-emitting part. A current produced by the emitted electrons will be hereinafter called an emission current Ie, while a current flowing between both electrodes is called a device current If.

Figure 3:
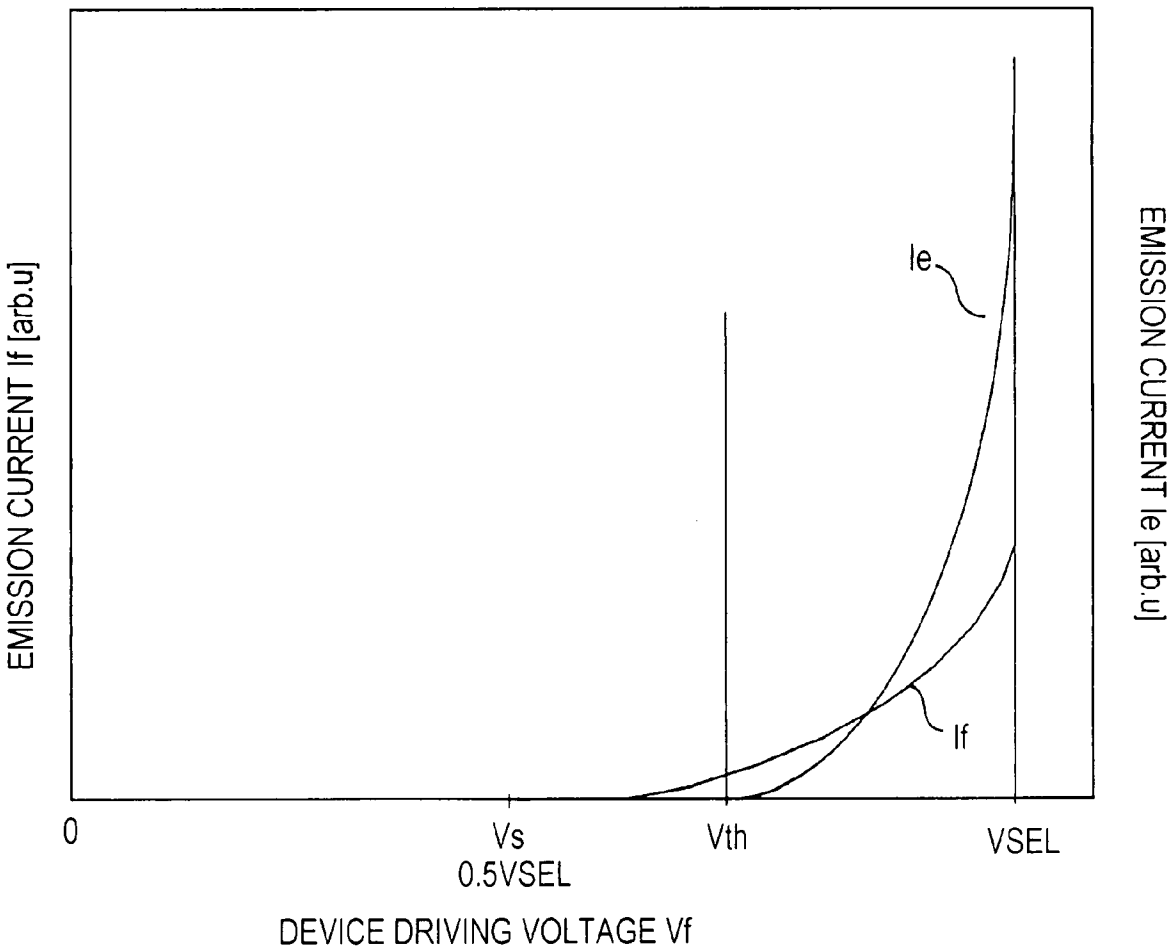
FIG. 3 is a graph showing the characteristics of a surface conduction electron-emitting device which is one example of the image display device according to the first embodiment.

FIG. 3 is a graph showing the characteristics of a surface conduction electron-emitting device which is one example of an image display device according to the first embodiment. As shown in FIG. 3, a typical surface conduction electron-emitting device has an (emission current Ie) vs. (device driving voltage Vf) characteristic and a (device current If) vs. (device driving voltage Vf) characteristic. Since the emission current Ie is remarkably small compared to the device current If and both currents Ie and If are difficult to represent on the same scale, their two curves are represented on different scales.

This surface conduction electron-emitting device has the following three characteristics as to the emission current Ie.

Firstly, when a voltage not lower than a certain voltage (called a threshold voltage Vth) is applied to the device, the emission current Ie increases sharply, whereas the emission current Ie is rarely detected in the case of a voltage lower than the threshold voltage Vth. Namely, the surface conduction electron-emitting device can be called a non-linear device having the threshold voltage Vth which is definite with respect to the emission current Ie.

Secondly, since the emission current Ie varies depending on the device driving voltage Vf applied to the device, the magnitude of the emission current Ie can be controlled by varying the device driving voltage Vf.

Thirdly, since the cold cathode device has a high-speed response, the emission time of the emission current Ie can be controlled by the application time of the device driving voltage Vf.

Because the surface conduction electron-emitting device has the above-described characteristics, the device can be suitably used in a display apparatus. For example, by using the first characteristic, the display apparatus can perform display while sequentially scanning its display screen. Namely, voltages not lower than the threshold voltage Vth are appropriately applied to devices which are being driven, according to a desired emission luminance, while voltages lower than the threshold voltage Vth are applied to devices which are placed in a non-selected state. The display apparatus can perform display while sequentially scanning the display screen by sequentially switching devices to be driven.

In addition, by using the second characteristic, the display apparatus can control the emission luminance of its phosphors according to the magnitude of the device driving voltage Vf to be applied to the devices, whereby it is possible to realize display of gray scale images and adjustment of image quality.

In addition, by using the third characteristic, the display apparatus can control the emission time of the phosphors according to the time for which to apply the device driving voltage Vf to the devices, whereby it is possible to realize display of gray scale images and adjustment of image quality.

Accordingly, the image display apparatus of the invention performs modulation for a display panel 1 by using both of the second and third characteristics.

Figure 4A:
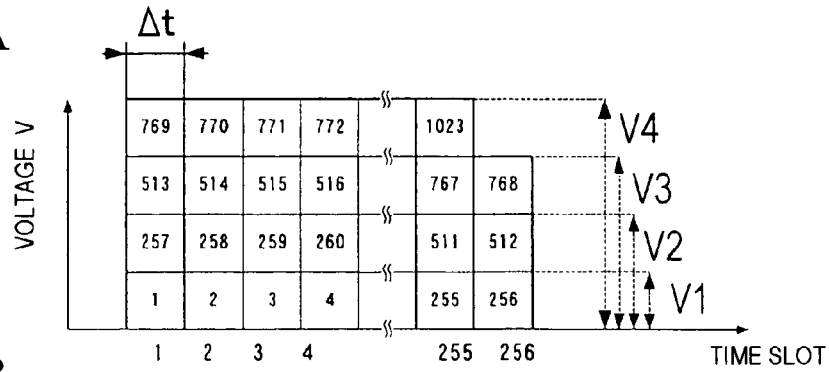
FIGS. 4A to 4C are schematic views showing one example of the waveform of a modulated pulse in the image display apparatus according to the first embodiment.
Figure 4B:
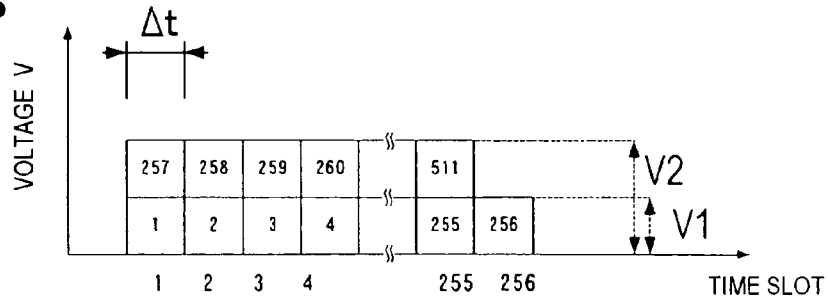
Figure 4C:
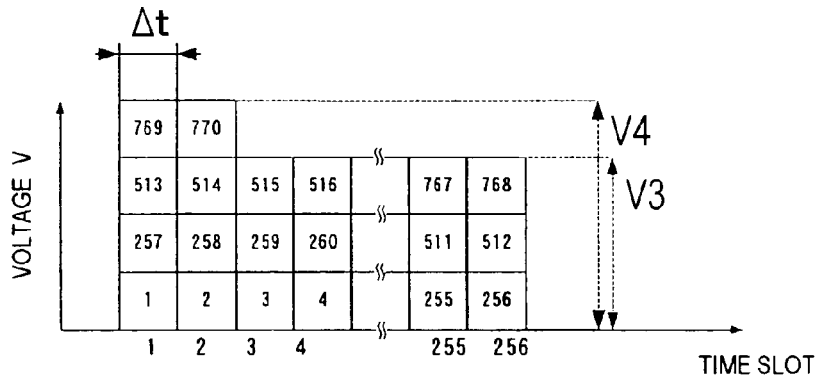

FIGS. 4A to 4C are schematic views showing one example of the waveform of a modulated pulse in the image display apparatus according to the first embodiment.

The driving pulse shown in FIGS. 4A to 4C is used in the invention on the basis of advantages such as the fast response of the cold cathode device and superior controllability of voltages.

The waveform shown in FIG. 4A is one example in which the number of bits of a modulation circuit (modulation means) is 10. In FIG. 4A, Δt represents one unit time (one time slot) during which a gray scale level increases in the direction of time, and the waveform has 256 time slots.

In the amplitude direction of voltage, four voltages V1, V2, V3 and V4 (in the first embodiment, $|V1|<|V2|<|V3|<|V4|$, where || represents an absolute value) are respectively shown according to different input values given to the modulation means.

The differences between the voltage amplitude values, i.e., $|V2|-|V1|$, $|V3|-|V2|$ and $|V4|-|V3|$, are each hereinafter called one unit voltage.

The numbers shown in FIGS. 4A to 4C correspond to the sizes of input data given to the modulation means, and in the waveform of FIGS. 4A to 4C, if the input data given to the modulation means is X, a waveform made of blocks each assigned a number not greater than X is outputted.

For example, if the input data is 511 (decimal number), the voltage V2 is outputted during the 1st to 255th time slots and the voltage V1 is outputted during the 256th time slot (FIG. 4B).

Similarly, if the input data is 770 (decimal number), the voltage V4 is outputted during the 1st and 2nd time slots and the voltage V3 is outputted during the 3rd to 256th time slots (FIG. 4C).

According to the invention, in the image display apparatus which outputs a driving voltage waveform modulated in the time direction and in the voltage-amplitude direction on the basis of input data given to the modulation means that corresponds to image data, when compensation of voltage drops which will be described below is performed, the integral value of the amount of the compensation is increased by maintaining the method of forming this voltage waveform.

Namely, when the input data is to be increased by one unit as the compensation of the voltage drops, the time slot is first preferentially increased (increased by one unit time), and if the time slot is satisfied, the voltage amplitude value is increased by one unit voltage.

Figure 5A:
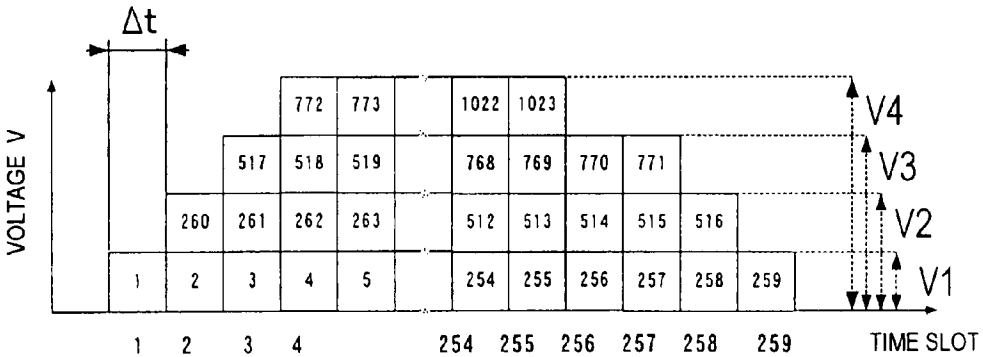
FIGS. 5A and 5B are schematic views showing another example of the waveform of the modulated pulse in the image display apparatus according to the first embodiment.
Figure 5B:
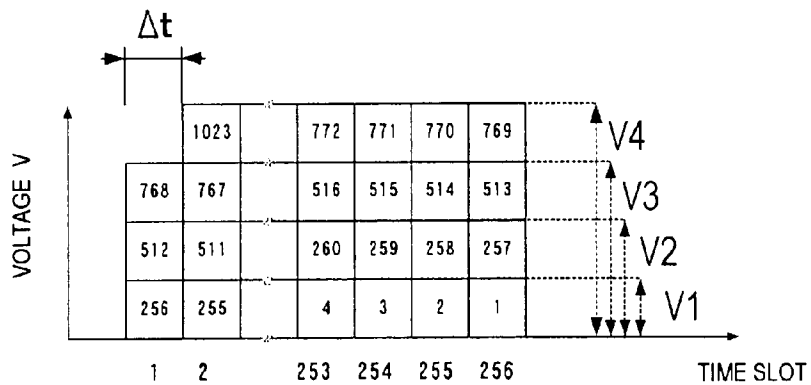

The waveform shown in FIG. 4 is merely one example, and waveforms such as those shown in FIGS. 5A and 5B may also be used.

In the above-described example, the voltage amplitude direction are realized by switching four power sources, but this method is not construed to be particularly limitative.

The potential difference between any of the potentials V1, V2, V3 and V4 and a selecting voltage Vs which a scanning circuit outputs to a selected scanning wiring is set to be larger than the threshold voltage Vth shown in FIG. 3.

The potential difference between any of the potentials V1, V2, V3 and V4 and a non-selecting voltage Vns which the scanning circuit outputs to a non-selected scanning wiring is set to be smaller than the threshold voltage Vth.

By setting operating points in this manner, it is possible to suitably perform modulation by the modulation method of the first embodiment.

A voltage drop compensation method according to the first embodiment will be described below.

(Voltage Drop Compensation Method)

When voltage drops are to be compensated for in the above-described modulation method, the quantities of voltage drops which actually occur needs to be calculated as a preparatory step.

To predict the quantity of a voltage drop to occur on the row wiring 1003, the present inventors have taken account of the following characteristics (1) to (3).

(1) The output waveform of the modulation means is a waveform which temporally varies as shown in FIGS. 4A to 4C. However, the temporal variation assumes a waveform which varies from a certain potential to a potential immediately below the same during one horizontal scanning period and subsequently takes a constant potential, so that a variation in current is small. In the case of a display image such as a picture of nature, various shapes of driving pulses are applied from individual columns and a combined current made of currents produced by the application of the driving pulses flow in scanning wirings, and therefore, this combined current also has small temporal variation. Accordingly, the quantity of a voltage drop produced by the combined current flowing in the scanning wirings also has small temporal variation.

From this characteristic, in the first embodiment, the temporal variation of the quantity of a voltage drop which occurs during one horizontal scanning period is ignored, and compensation is performed on the basis of the quantity of a voltage drop which occurs averagely during one horizontal scanning period (the average quantity of a voltage drop during one horizontal scanning period is hereinafter called "effective voltage drop quantity").

In addition, as the next approximation, the effective voltage drop quantity is calculated on the assumption that a voltage of effective amplitude value is applied which is obtained by averaging the temporal variations of modulated pulses applied to modulation wirings.

(2) In the Vf vs. If characteristic curve shown in FIG. 3, in the case where a device current occurring when an effective voltage VF0 is applied across the surface conduction electron-emitting device is defined as If0, if the device current of If0 is injected into the surface conduction electron-emitting device, the effective voltage VF0 is produced across the device.

(3) Voltage drops which occur in row wirings selected when the device current If1, a device current If2, . . . , and a device current IfN are respectively made to flow in a column wiring 1, a column wiring 2, . . . , and a column wiring N satisfy a so-called principle of superposition, so that voltage drops which occur when the respective device currents are made to flow in the individual column wirings can be easily calculated as a superposed voltage drop quantity.

Therefore, in the first embodiment, the voltage drop quantity is calculated in accordance with the following steps.

First of all, input image data is converted to effective voltage values to be applied to the individual modulation wirings when the input image data is directly inputted to the modulation means.

Then, the effective voltage values are converted to the effective quantities of device currents which flow when the effective voltage values are applied to surface conduction electron-emitting devices on the selected column wirings.

Further, voltage drop quantities on the column wirings when the device currents are made to flow in the respective column wirings are calculated in accordance with the characteristic (3).

Further, the calculated voltage drop quantities are respectively added to the above-described effective voltage values to compensate for the same.

Further, the obtained voltage values are converted to modulation data which enables the average value of the amplitudes to become an effective voltage value to be obtained by addition, and the modulation data is inputted to the modulation means.

FIGS. 6A to 6D are views for describing a method of calculating voltage drops on row wirings from device current quantities on the basis of the above-described characteristic (3).

In FIGS. 6A to 6D, for the sake of simplicity, only four column wirings are shown, and the illustration of row wirings is omitted except selected row wirings. A potential on each of the selected row wirings is described as a ground potential, because the potential serves as a basis for calculation of voltage drop quantities on the row wirings.

In addition, in FIGS. 6A to 6D, r denotes the resistance value of a row wiring between an arbitrary one of the column wirings and an adjacent one, and the resistance value r is common in the section between each of the column wirings. A row wiring lead portion also has the resistance r. Surface conduction electron-emitting devices connected between the column wirings and the row wirings are also omitted because the surface conduction electron-emitting devices are not needed in terms of calculation.

Figure 6A:
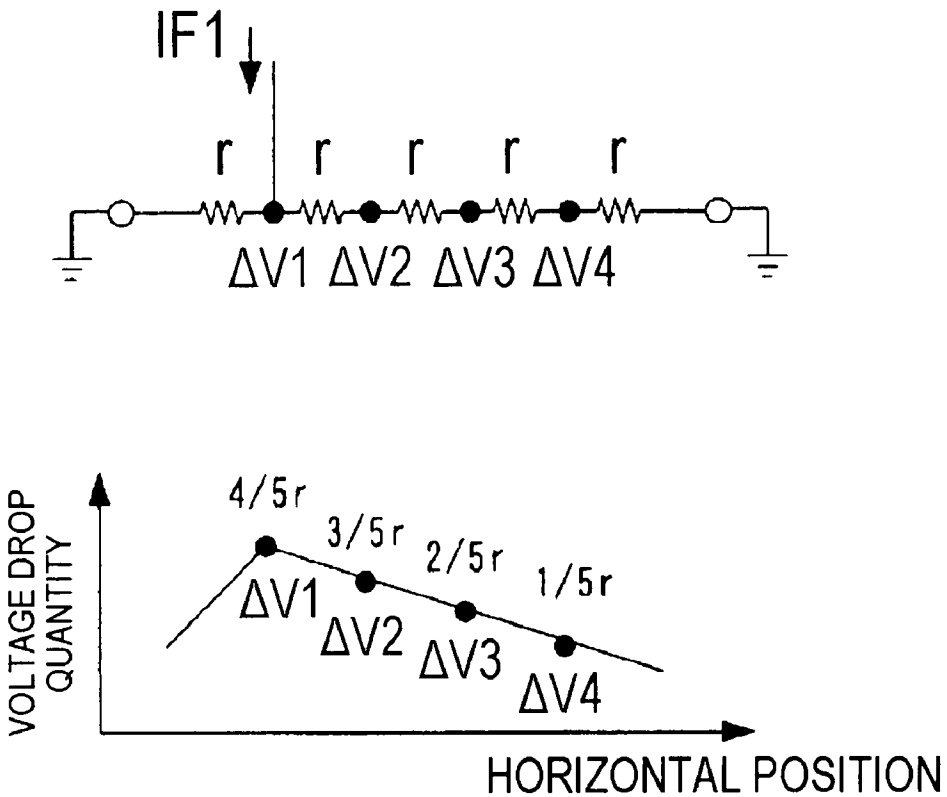
FIGS. 6A to 6D are views for describing a method of calculating voltage drops on row wirings from device current quantities.

FIG. 6A shows an example of the case where the device current If1 is injected into only the column wiring 1. Potentials which occur at ΔV1 to ΔV4 at this time are as shown by a line graph on the right side of FIG. 6A (the vertical axis represents potentials and the horizontal axis represents horizontal positions), and the following potential differences occur with respect to the ground potential.

$$\Delta V1=4/5\times r\times If1,$$

$$\Delta V2=3/5\times r\times If1,$$

$$\Delta V3=2/5\times r\times If1, \text{ and}$$

$$\Delta V4=1/5\times r\times If1. \qquad \text{[Equations 1]}$$

Figure 6B:
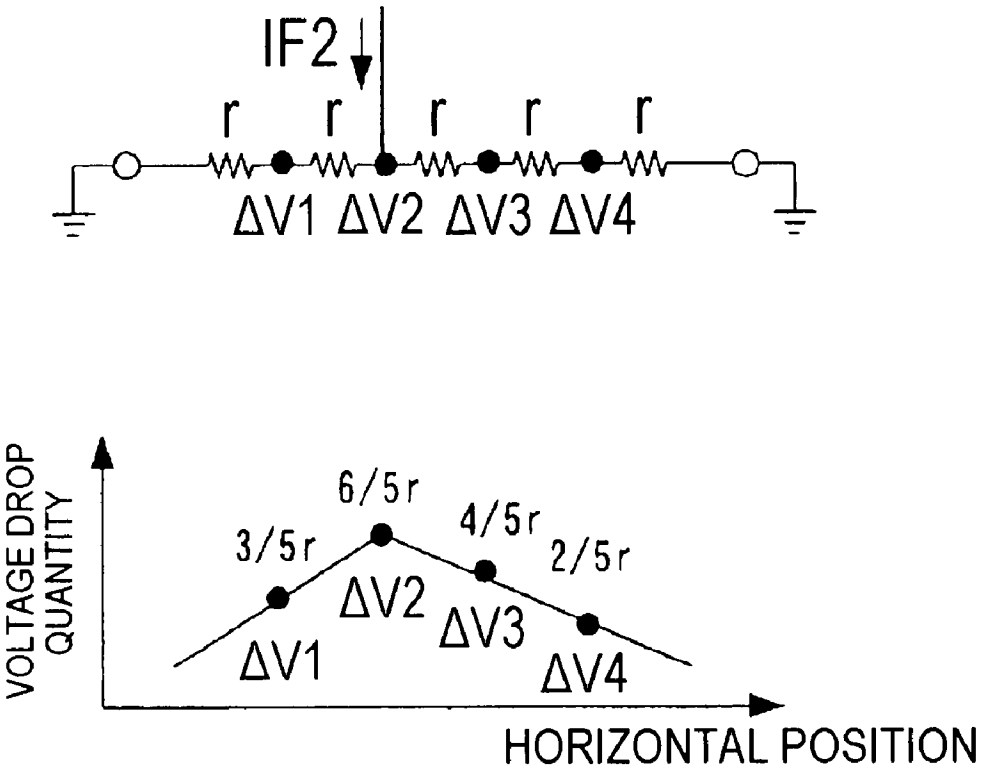

FIG. 6B likewise shows an example of the case where the device current If2 is injected into only the column wiring 2. Potentials which occur at ΔV1 to ΔV4 at this time are as shown by a line graph on the right side of FIG. 6B, and the following potential differences occur with respect to the ground potential.

$$\Delta V1=3/5r\times If2,$$

$$\Delta V2=6/5\times r\times If2,$$

$$\Delta V3=4/5\times r\times If2, \text{ and}$$

$$\Delta V4=2/5\times r\times If2$$

Figure 6C:
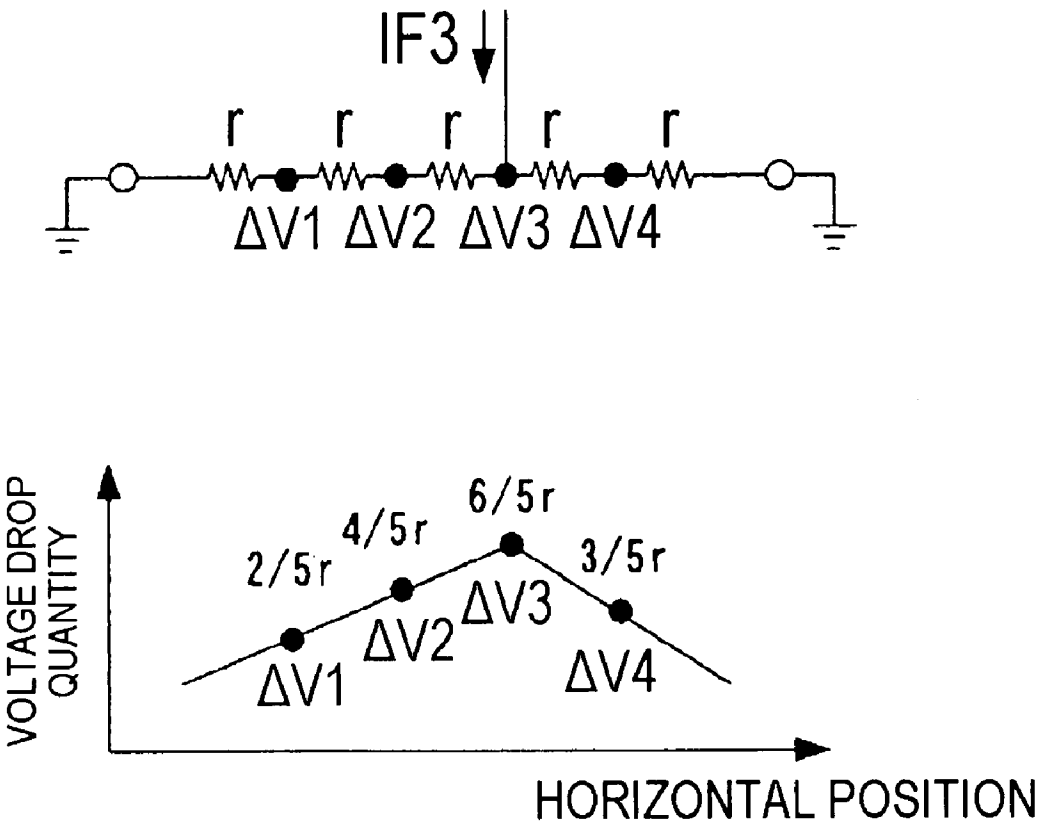

FIG. 6C likewise shows an example of the case where the device current If3 is injected into only the column wiring 3. Potentials which occur at ΔV1 to ΔV4 at this time are as shown by a line graph on the right side of FIG. 6C, and the following potential differences occur with respect to the ground potential.

$$\Delta V1=2/5\times r\times If3,$$

$$\Delta V2=4/5\times r\times If3,$$

$$\Delta V3=6/5\times r\times If3, \text{ and}$$

$$\Delta V4=3/5\times r\times If3. \qquad \text{[Equations 3]}$$

Figure 6D:
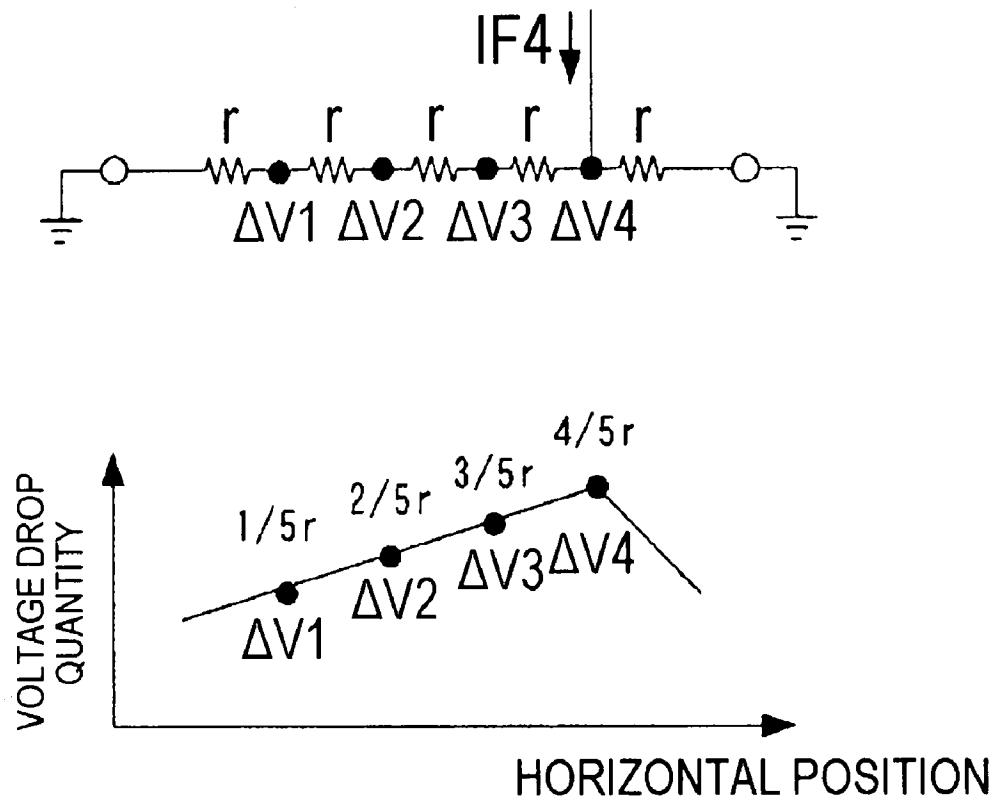

FIG. 6D likewise shows an example of the case where the device current If4 is injected into only the column wiring 4. Potentials which occur at ΔV1 to ΔV4 at this time are as shown by a line graph on the right side of FIG. 6D, and the following potential differences occur with respect to the ground potential.

$$\Delta V1=1/5\times r\times If4$$

$$\Delta V2=2/5\times r\times If4,$$

$$\Delta V3=3/5\times r\times If4, \text{ and}$$

$$\Delta V4=4/5\times r\times If4. \qquad \text{[Equations 4]}$$

From the above-described characteristic (3), these equations 1 to 4 satisfy the principle of superposition, so that when the respective device currents If1 to If4 are injected into the column wirings 1 to 4, potentials occur at ΔV1 to ΔV4 according to Equation 5.

$$\begin{bmatrix} \Delta V1 \\ \Delta V2 \\ \Delta V3 \\ \Delta V4 \end{bmatrix} = \frac{r}{5}\begin{bmatrix} 4 & 3 & 2 & 1 \\ 3 & 6 & 4 & 2 \\ 2 & 4 & 6 & 3 \\ 1 & 2 & 3 & 4 \end{bmatrix}\begin{bmatrix} If1 \\ If2 \\ If3 \\ If4 \end{bmatrix}. \qquad \text{[Equation 5]}$$

In the description of the first embodiment, reference has been made to a simple model including four column wirings.

However, the present inventors have confirmed that the above-described law applies in principle to other cases where a far larger number of column wirings are used or the resistance values of wirings are not uniform, even though the constant and the like change.

The image display apparatus includes not smaller than 100 column wirings. However, even if the number of column wirings increases, the voltage drop quantities on selected column wirings can be calculated by repeating the above-described calculation method as to each of the column wirings.

In the case of a display panel having N number of column wirings, this calculation is performed as the matrix operation shown by Equation 6. However, to execute the operation of Equation 6 in synchronism during one horizontal scanning period, the number of calculations becomes extremely large so that large scale hardware is needed (an N×N product-sum operation needs to be performed by N times).

$$\begin{bmatrix} \Delta V1 \\ \Delta V2 \\ \Delta V3 \\ \vdots \\ \Delta VN \end{bmatrix} = \begin{bmatrix} a11 & a12 & \cdots & a1N \\ a21 & a22 & \cdots & a2N \\ a31 & a32 & \cdots & a3N \\ \vdots & \vdots & \vdots & \vdots \\ aN1 & aN2 & \cdots & aNN \end{bmatrix} \begin{bmatrix} If1 \\ If2 \\ If3 \\ \vdots \\ IfN \end{bmatrix} \quad \text{[Equation 6]}$$

where aij(i=1 to N, j=1 to N) is a constant determined by the value of wiring resistance.

Figure 7A:
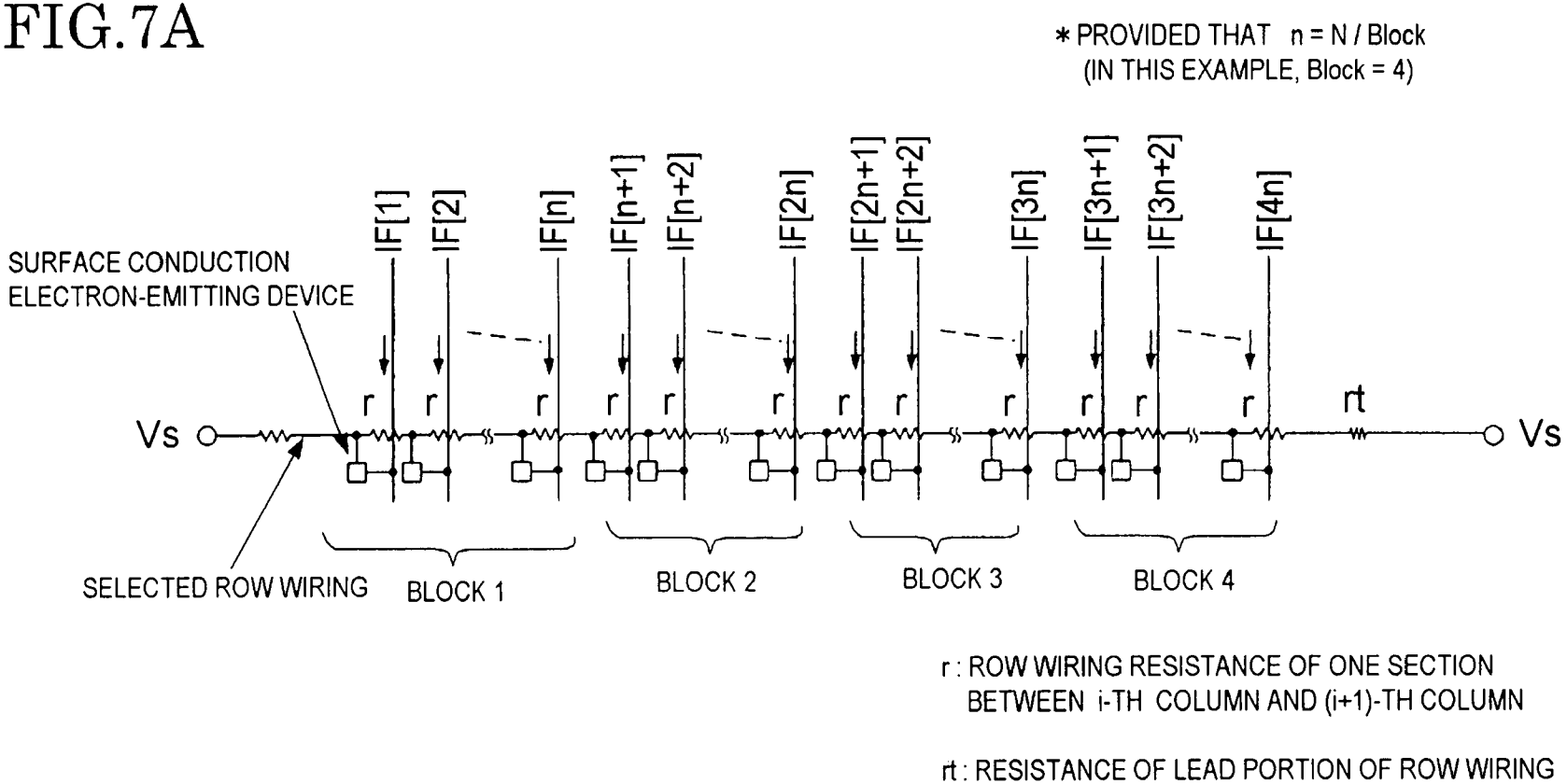
FIGS. 7A and 7B are views for schematically describing an approximate model introduced in a method of calculating voltage drop quantities in the first embodiment.
Figure 7B:
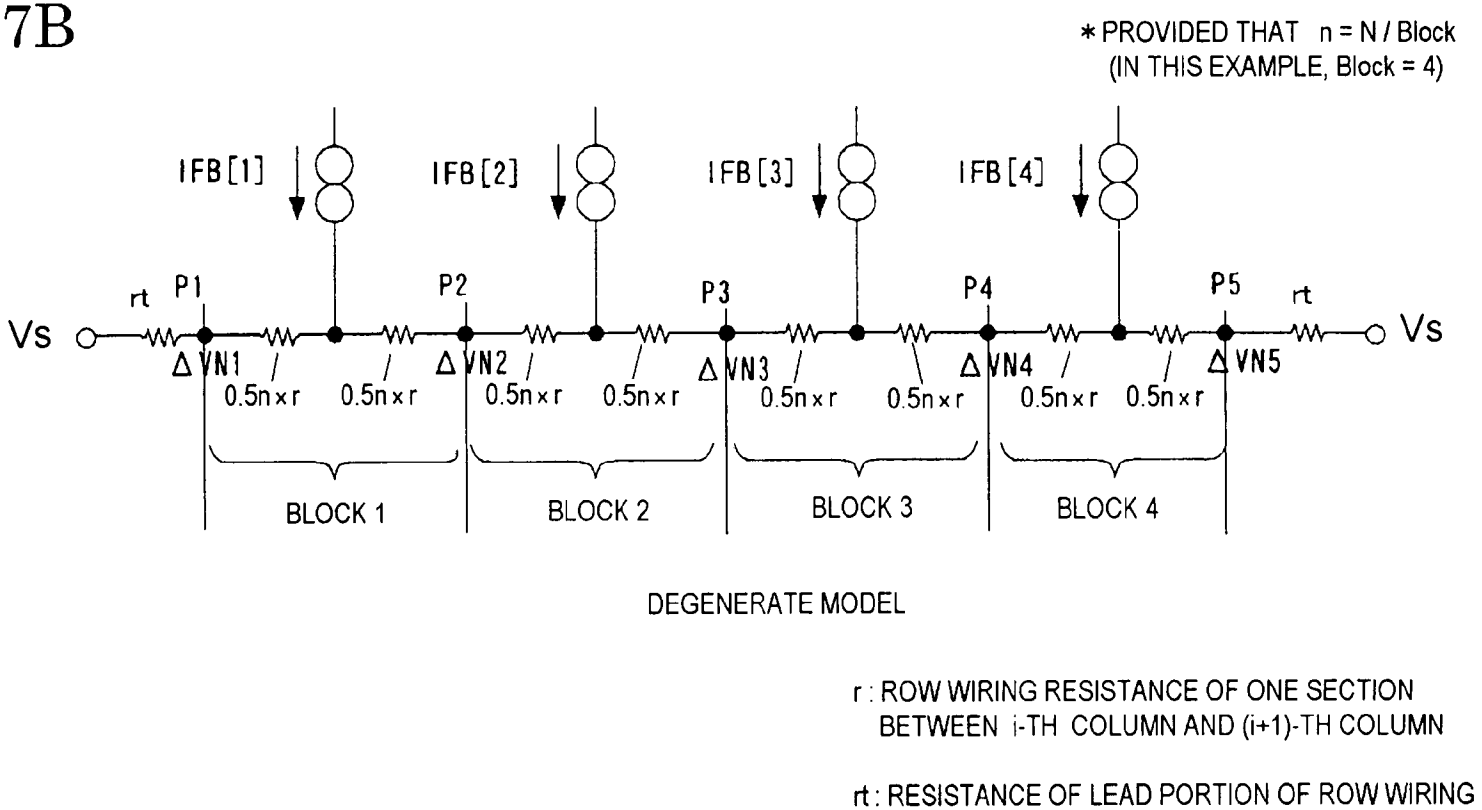

Accordingly, the present inventors adopt a method of calculating an approximate solution of a voltage drop quantity by means of a degenerate approximate model in order to simplify calculations. FIGS. 7A and 7B are views for schematically describing a degenerate approximate model (refer to FIG. 7B) of a display panel (refer to FIG. 7A) in the method of calculating the voltage drop quantity.

Namely, as shown in FIGS. 7A and 7B, the following modeling is performed.

(1) N number of column wirings are grouped into four blocks (n=N/Block; Block=4).

(2) The sum of device currents in each of the blocks is made to flow into the center of the same.

(3) Nodes P1 to P5 are defined at boundary positions between the blocks, and the potential differences (voltage drop quantities) between the potentials of the nodes P1 to P5 and supply end potentials (Vs) of selected column wirings are respectively defined as ΔVN1 to ΔVN5 (the reason for this is to make it easy to calculate linear approximation which will be described later, because the nodes are defined at the boundary positions between the blocks).

(4) The value of the resistance between each adjacent one of the nodes is multiplied by n in terms of degeneration. ΔVN1 to ΔVN5 in the degenerate model shown in FIG. 7B can be easily calculated by the matrix operation expressed as Equation 7.

$$\begin{bmatrix} \Delta VN1 \\ \Delta VN2 \\ \Delta VN3 \\ \Delta VN4 \\ \Delta VN5 \end{bmatrix} = \begin{bmatrix} b11 & b12 & b13 & b14 \\ b21 & b22 & b23 & b24 \\ b31 & b32 & b33 & b34 \\ b41 & b42 & b43 & b44 \\ b51 & b52 & b53 & b54 \end{bmatrix} \begin{bmatrix} IFB[1] \\ IFB[2] \\ IFB[3] \\ IFB[4] \end{bmatrix} \quad \text{[Equation 7]}$$

where bij(i=1 to 5, j=1 to 4) is a constant determined by the value of wiring resistance, and IFB[J] (J=1, 2, . . . BLOCK) is the sum of current values IF[I] contained in the block J.

In the case of BLOCK=4 in this example, IFB[J] can be calculated as follows:

$$IFB[1] = \sum_{I=1}^{n} IF[I], \quad \text{[Equation 8]}$$

$$IFB[2] = \sum_{I=n+1}^{2n} IF[I],$$

$$IFB[3] = \sum_{I=2n+1}^{3n} IF[I], \text{ and}$$

$$IFB[4] = \sum_{I=3n+1}^{4n} IF[I],$$

where n represents the number of column wirings contained in one block, and n=N/BLOCK=N/4.

The device current IF[I] (I=1, 2, . . . , N) in a certain column wiring can be found from the characteristic of FIG. 3 as a current which flows when an effective voltage AVF[I] (I=1, 2, . . . , N) for each of the column wirings is applied across the surface conduction electron-emitting device.

In addition, bij represents a potential produced at the i-th node when a unit current is injected into the j-th block, on the basis of the end portions of the row wiring. This bij is a constant determined by the value of wiring resistance, and can be calculated in accordance with Kirchhoff's laws.

Accordingly, by performing the calculation of Equation 7, it is possible to approximately find the values ΔVN1 to ΔVN5 of voltage drops at the nodes P1 to P5.

Then, in the first embodiment, the voltage drop quantity on the column wiring positioned between adjacent ones of the nodes is found by performing linear approximation with voltage drop quantities $\Delta VN_k$ and $\Delta VN_{k+1}$ at the two adjacent nodes on the basis of Equation 9.

$$\Delta V[I] = \frac{\Delta VN_k \times (x_{k+1} - x) + \Delta VN_{k+1} \times (x - X_k)}{X_{k+1} - X_k}. \quad \text{[Equation 9]}$$

Since the positions of the respective nodes are set at the boundaries between the blocks as described above, there is a merit which enables a voltage drop quantity at a point between adjacent middle ones of the blocks to be easily linearly approximated even at a block positioned at either of extreme ends of the row wiring. Namely, it is possible to perform linear approximation at the extreme-end block more easily than to define a node between the middle ones of the blocks.

In the above example, the number of blocks is four, but it goes without saying that it is possible to reduce approximation error by increasing the number of blocks. Since the curve of the voltage drop occurring on the row wiring is a smooth curve, the practical problem of this approximation error due to linear approximation can be nearly solved by sufficiently increasing the number of blocks.

As the number of blocks, an optimum value may be selected in terms of the value of wiring resistance, the characteristics of surface conduction electron-emitting devices, modulated voltage, the number of column wirings, error caused by these factors, and the like.

As to the number of calculations, in the case where approximation is not performed, N number of product-sum operations must be repeated by N times. However, in the case where approximation is performed, as shown by the matrix operation of Equation 7, a product-sum operation needs only to be repeated by (BLOCK)×(BLOCK+1) times, whereby the number of calculations can be greatly reduced (in the above-described example, since BLOCK=4, 4×5=20 product-sum operations suffice). In general, this number of calculations can be executed within a period of time sufficiently shorter than one horizontal scanning period.

By adding the voltage drop quantities calculated in the above-described manner to modulated potentials to be applied to the column wirings and applying to the column wirings the modulated potentials which are offset by the added quantities, emission currents emitted from the respective surface conduction electron-emitting devices are prevented from being influenced by voltage drops on the row wirings.

Accordingly, by applying this compensation, it is possible to ameliorate the degradation of images due to the influence of voltage drops that has so far been a problem.

In addition, since calculations are performed with approximation using the above-described calculation method without calculations performed on all the column wirings, it is possible to calculate voltage drop quantities by the matrix operation of Equation 7 and the linear approximation of Equation 9, whereby it is possible to remarkably reduce the number of calculations in comparison with the large scale matrix operation of Equation 6.

In addition, by reducing the number or calculations, it is possible to realize the calculations of Equation 7 and Equation 9 by means of hardware having a very simple construction as described below.

The above description has referred to the calculation of voltage drop quantities according to the invention.

The entire construction of the image display apparatus containing a processing circuit for performing compensation of voltage drops in the above-described manner will be described below.

(Description of the Entire System and the Functions of Individual Parts)

Figure 1:
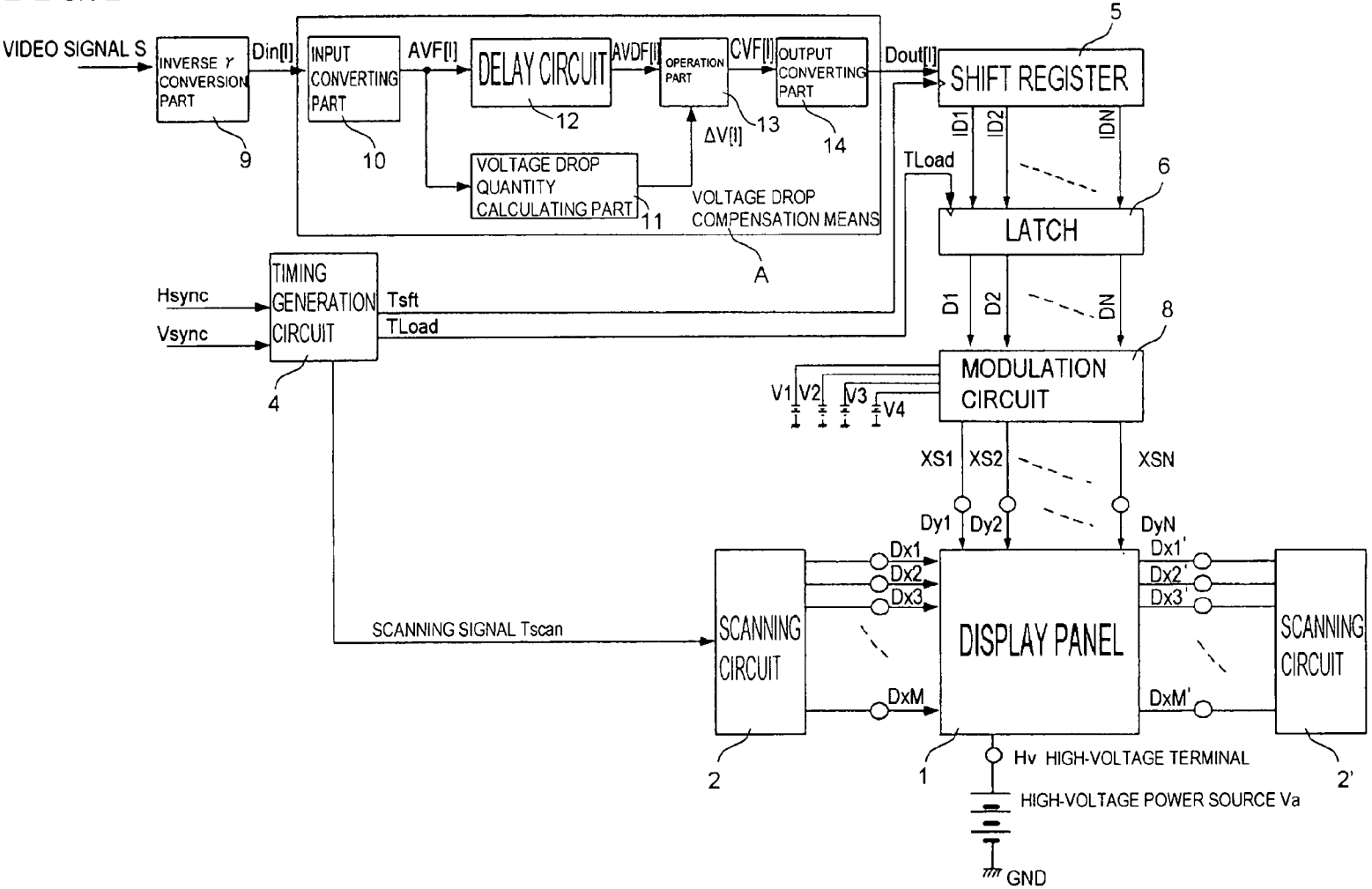
FIG. 1 is a block diagram schematically showing the circuit construction of an image display apparatus according to the first embodiment.

FIG. 1 is a block diagram schematically showing the circuit construction of the image display apparatus according to the first embodiment.

An image display apparatus 100 includes the display panel 1, connecting terminals Dx1 to DxM and Dx1' to DxM' of the row wirings of the display panel 1, connecting terminals Dy1 to DyN of the column wirings of the display panel 1, a high-voltage terminal Hv for applying an acceleration voltage between a faceplate 1007 and a rear plate 1005 (refer to FIG. 2), a high-voltage power source Va, scanning circuits 2 and 2', and a modulation circuit 8 for outputting the waveform described previously with reference to FIGS. 4A to 4C.

An inverse γ conversion part 9 inversely converting a video signal which is γ-corrected to show linear luminance characteristics when displayed on a CRT, into a signal for the display panel 1 of the invention. A timing generating circuit 4 generates timing for each part. A shift register 5 stores data for one line. A latch circuit 6 is a circuit which latches data for one line. Voltage drop compensation means A according to the first embodiment has an input converting part 10, a voltage drop quantity calculating part 11, a delay circuit part 12, an operation part 13, and an output converting part 14.

Incidentally, the image display apparatus 100 according to the first embodiment is capable of coping with various video sources such as SD, HD and MPEG, but for the sake of simplicity, the following description will refer to processing subsequent to decoding into R, G and B video signals (In the processing of the invention, since different processes are not executed on R, G and B video signals, the following description refers to the processing of a single video signal).

(Scanning Circuit)

The scanning circuits 2 and 2' output a selecting potential Vs or a non-selecting potential Vns to the connecting terminals Dx1 to DxM and Dx1' to DxM, respectively, in order to sequentially scan the display panel 1 on a row-by-row basis.

The scanning circuits 2 and 2' perform scanning by sequentially switching scanning wirings to be selected, at intervals of one horizontal scanning period in synchronism with a timing signal Tscan from the timing generating circuit 4.

Incidentally, the timing signal Tscan is a group of timing signals produced from a vertical scanning signal and a horizontal scanning signal.

Figure 8:
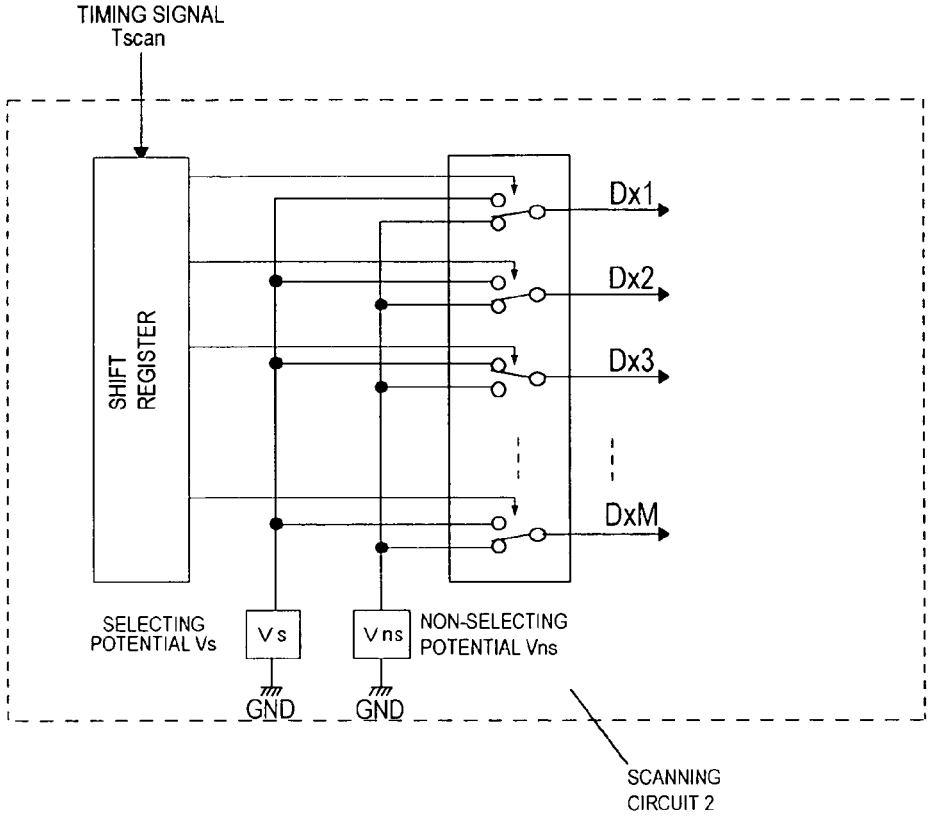
FIG. 8 is a view schematically showing a scanning circuit according to the first embodiment.

Each of the scanning circuits 2 and 2' includes M number of switches 201, a shift register 202 and the like, as shown in FIG. 8. Each of these switches 201 is preferably made of a transistor or an FET.

In order to reduce voltage drops on the row wirings, it is preferable that, as shown in FIG. 1, the scanning circuits 2 and 2' be connected to the opposite ends of each of the row wirings of the display panel 1 to drive the display panel 1 from the opposite ends. Of course, the invention is effective even in the case where scanning circuits are not connected to the opposite ends of row wirings, and is applicable to such a case merely by modifying the parameters of the compensating means which will be described below.

(Voltage Drop Compensation Means A)

The voltage drop compensation means A is a circuit which calculates the quantity of a voltage drop to occur on a scanning wiring. The voltage drop compensation means A predicts a voltage drop quantity which averagely occurs during one horizontal scanning period, on the assumption that a temporal variation in the quantity of a voltage drop to occur on a scanning wiring is small as described previously.

(Input Converting Part 10 (Effective Voltage Calculating Means))

The input converting part 10 is means for calculating the effective voltage data AVF[I] (I represents a horizontal position, where I=1, 2, . . . , N) from inverse-γ-converted image data Din[I] in a certain horizontal line in order to find an effective voltage value (an effective voltage averaged in the time direction) obtainable when the image data Din[I] is directly inputted to the modulation circuit 8 which is the modulation means.

Figure 9:
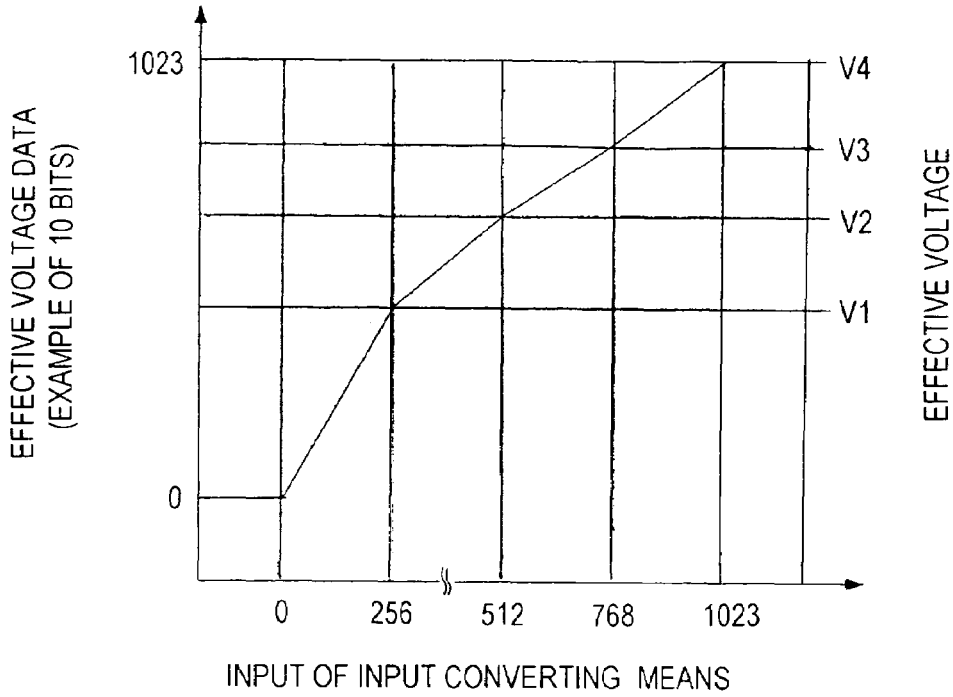
FIG. 9 is a graph showing a conversion table in input converting means according to the first embodiment.

More specifically, the input converting part 10 performs conversion such as that shown in FIG. 9 while taking the output characteristics (FIGS. 4A to 4C) of the modulation circuit 8 in account, to convert image data corresponding to individual column wirings on a selected row wiring into effective voltage data, respectively. The input converting part 10 can be easily constructed by using a table memory or the like.

(Voltage Drop Quantity Calculating Part 11)

The voltage drop quantity calculating part 11 is means for calculating a voltage drop quantity from the effective voltage data.

As described above in the first embodiment as well, the voltage drop quantity calculating part 11 is constructed to calculate a voltage drop quantity by using a degenerate model reduced in the number of calculations.

Figure 10:
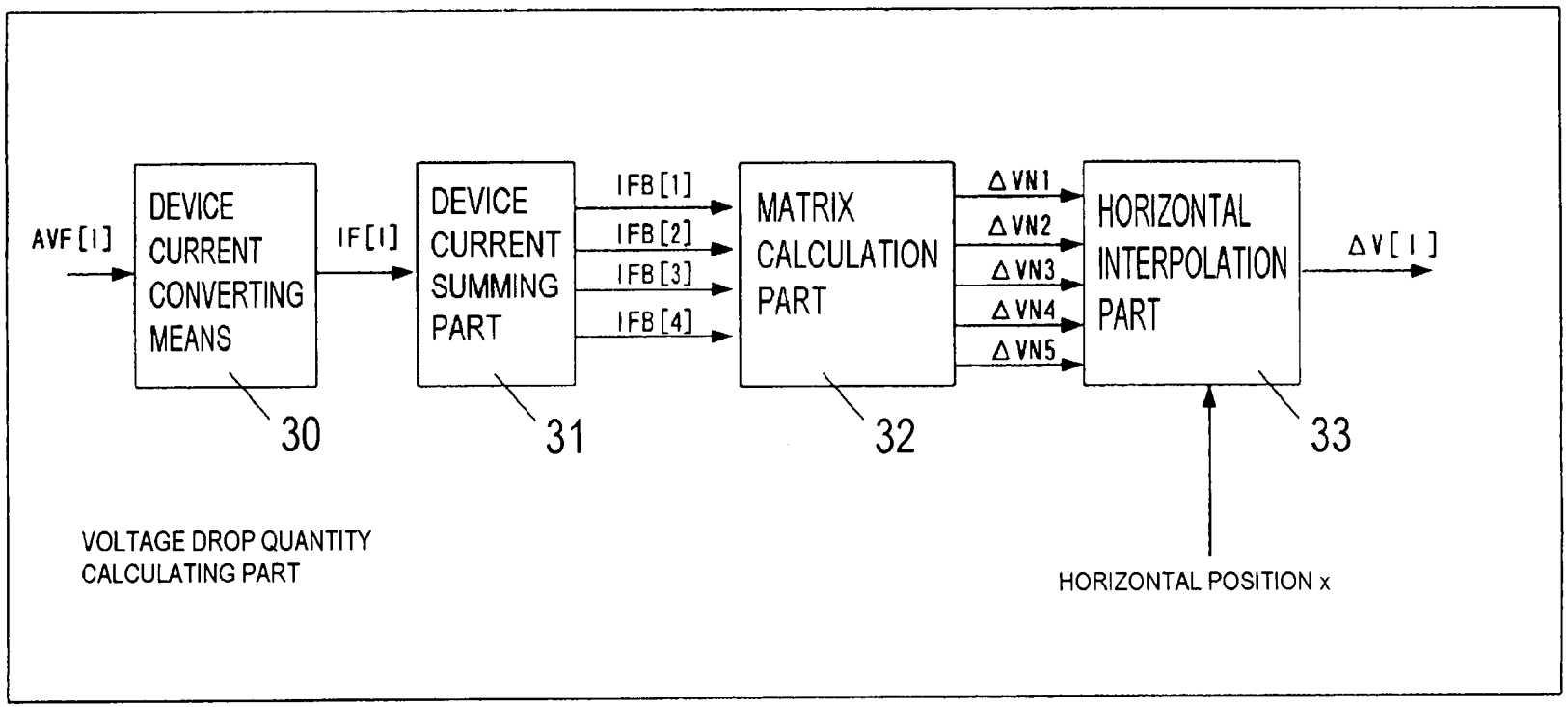
FIG. 10 is a block diagram schematically showing a voltage drop quantity calculating part according to the first embodiment.

As shown in FIG. 10, the voltage drop quantity calculating part 11 includes four parts, i.e., a device current converting part (means) 30, a device current summing part 31, a matrix calculation part 32 and a horizontal interpolation part 33.

The device current converting part 30 is a circuit which converts the effective voltage data into device current data.

The device current converting part 30 converts the effective voltage data AVF [I] (I=1, 2, . . . , N, where I represents a horizontal position) into device current data IF[I] (I=1, 2, . . . , N, where I represents a horizontal position) on the basis of the (device current If) vs. (device driving voltage Vf) curve shown in FIG. 3.

The device current summing part 31 divides the horizontal direction of the display screen into a plurality of blocks, and calculates the sum IFB[J] (J=1, 2, . . . , 4, where J represents a block number) of the device currents If of the individual blocks.

The matrix calculation part 32 is a circuit which performs the matrix operation described as Equation 7.

The voltage drop quantity calculating part 11 performs the above-described processing to calculate the voltage drop quantities (voltage drop quantity data) ΔVN1 to ΔVN5 at horizontal positions corresponding to the respective nodes.

To find a voltage drop quantity at an arbitrary position, the horizontal interpolation part 33 performs horizontal interpolation on the discrete voltage drop quantities given by Equation 9. In the invention, interpolation is performed by linear approximation and voltage drop quantity data ΔV[I] (I=1, 2, . . . , N) at an arbitrary horizontal position I is calculated.

(Delay Circuit Part 12)

The delay circuit part 12 is an operation circuit which will be described later, and serves as a circuit which delays the effective voltage data AVF [I] to cause the timing of an effective voltage and the timing of a voltage drop quantity to coincide with each other when the effective voltage and the voltage drop quantity are to be added together.

The delay circuit part 12 delays the effective voltage data AVF [I] and converts it to effective voltage data AVFD[I] (I=1, 2, . . . , N, where I represents a horizontal position), and outputs the effective voltage data AVFD[I] to the operation part 13.

(Operation Part 13)

The operation part 13 serves as means for adding the voltage drop quantities ΔV[I] (I=1, 2, . . . ., N) corresponding to individual horizontal positions to the effective voltage data AVFD[I] (I=1, 2, . . . , N) corresponding to image data Data[I] (I=1, 2, . . . , N) at the individual horizontal positions.

Namely, the following operation is performed by considering the horizontal position I;

$$CVF[I]=AVFD[I]+\Delta V[I]\ (I=1, 2, \ldots, N), \qquad \text{[Equation 10]}$$

and corrected effective voltage data CVF[I] is calculated.

(Output Converting Part 14)

The output converting part 14 serves as means for calculating, on the basis of the corrected effective voltage data CVF[I], an input value to be given to the modulation means so that the output of the modulation means provides a similar effective voltage.

Specifically, the output converting part 14 performs the inverse conversion of the conversion shown in FIG. 9 and calculates corrected image data Dout[I] corresponding to the input of the modulation means.

(Shift Register 5 and Latch Circuit 6)

The image data Dout[I] (I=1, 2, . . . , N) which is the output from the operation means is converted from its serial data format to parallel image signals ID1 to IDN for individual column wirings through serial/parallel conversion by the shift register 5. Then, the image signals ID1 to IDN are loaded into the latch circuit 6 by a timing signal Tload immediately before one horizontal scanning period is started. The latch circuit 6 supplies parallel image signals D1 to DN to the modulation means.

In the first embodiment, the image signals ID1 to IDN and D1 to DN are 8-bit image signals, respectively. These shift register 5 and latch circuit 6 operate at operating timing based on a timing control signal Tsft and the timing control signal Tload supplied from the timing generating circuit 4.

(Modulation Means (Circuit) 8)

The modulation circuit 8 is constructed to output the modulated pulse shown in FIG. 4 to the inputs D1 to DN of the modulation circuit 8. The modulation means 8 can be easily constructed by using a counter for counting time slots, a comparator, a switch for switching V1 to V4, a decoder and the like.

This image display apparatus is capable of restraining the influence of voltage drops on row wirings which has heretofore been a problem, and ameliorating the degradation of a display image caused by the voltage drops, thereby providing an image of very good quality.

Second Embodiment

According to the voltage drop compensation method of the first embodiment, it is possible to suitably perform compensation of voltage drops.

On the other hand, there is the possibility that the construction of the first embodiment may cause the problem that the corrected image data Dout[I] exceeds the input range of the modulation means 8 to such an extent that preferable correction becomes impossible.

The cause of this problem is that a voltage corresponding to effective voltage data CFV[I] corrected by performing the correction exceeds the maximum voltage that can be outputted from the modulation means 8.

In the following description of the second embodiment, reference will be made to an example in which measures are taken against such a problem (hereinafter called "overflow").

Figure 11:
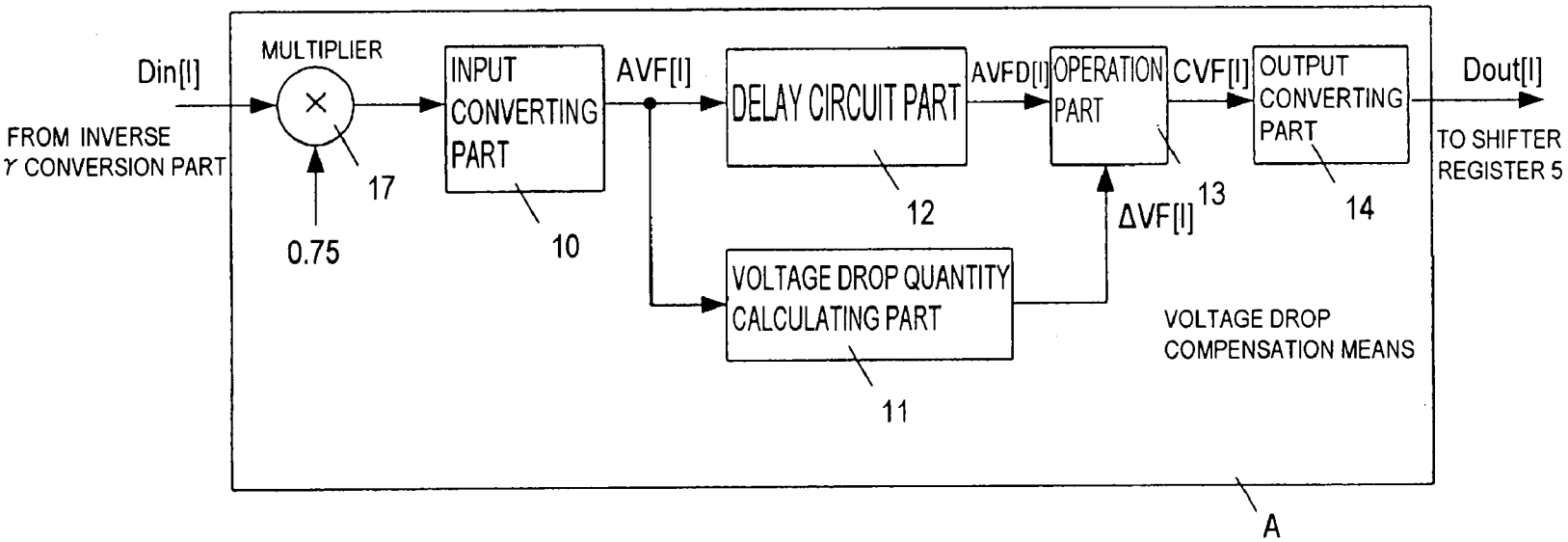
FIG. 11 is a block diagram schematically showing voltage drop compensation means according to a second embodiment.

FIG. 11 is a block diagram schematically showing the voltage drop compensation means A according to the second embodiment.

The second embodiment differs from the first embodiment in that the inverse-γ-converted image data Din[I] is multiplied by a mixed coefficient smaller than 1, thereby reducing a range which can be taken by the image data Din[I] (a multiplier 17).

In the second embodiment, as shown in FIG. 11, a coefficient of 0.75 is selected. However, this value is merely one example, and the coefficient may be selected so that a voltage corresponding to the corrected effective voltage data CFV[I] does not exceed the maximum voltage value (V4) that can be outputted from the modulation means 8.

It is to be noted that at the time of selection of the coefficient, if 100% full-screen white display is selected as the input, the voltage drop quantity at this time reaches its maximum, and if an overflow does not occur in this case, overflows can be prevented from occurring in any other case.

By constructing the circuit in the above-described manner, it is possible to more suitably perform compensation of voltage drops.

Third Embodiment

In the second embodiment, it is possible to more suitably perform compensation of voltage drops by multiplying input image data by a fixed gain to take measures against an overflow.

Figure 12:
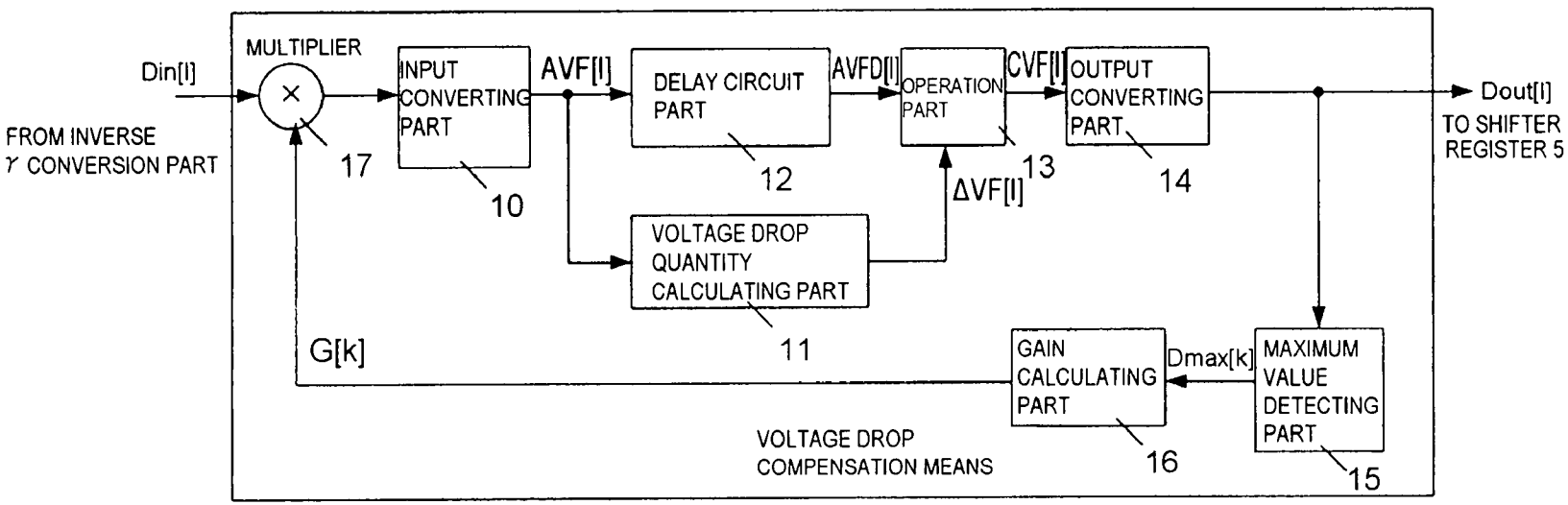
FIG. 12 is a block diagram schematically showing voltage drop compensation means according to a third embodiment.

In the following third embodiment, reference will be made to another construction which prevents an overflow. FIG. 12 is a block diagram schematically showing the voltage drop compensation means according to the third embodiment.

The third embodiment differs from the second embodiment in that the inverse-γ-converted image data Din[I] is multiplied by a coefficient (gain) which varies on a frame-by-frame basis, thereby reducing a range which can be taken by the image data Din[I].

In the third embodiment, as shown in FIG. 12, a maximum value Dmax[k] of the k-th frame of the corrected image data Dout[I] is detected (a maximum value detecting part 15). Further, a gain G[k] is calculated in the following manner so that the maximum value Dmax[k]is contained in the input maximum value MAXin (a gain calculating part 16).

$$G[k]=G[k-1]\times \mathrm{MAXin}/D\mathrm{max}[k], \quad \text{[Equation 11]}$$

where G[k] is the gain of the k-th frame.

Furthermore, the input image data Din[I] of the (k+1)-th frame is multiplied by the calculated gain G[k], to limit a range which can be taken by the input image data Din[I] (a multiplier 17).

This method of dynamically varying the gain on a frame-by-frame basis offers the merit of enabling effective use of the output range of the modulation means 8, and is greatly superior in that particular kinds of images can be displayed with higher luminance and higher gray scale levels than can be displayed in the second embodiment.

Incidentally, there is the problem that although the above-described gain calculating method can prevent overflows, a visible flicker may also be caused in an image because the variation of the gain between frames is excessively large.

Figure 13:
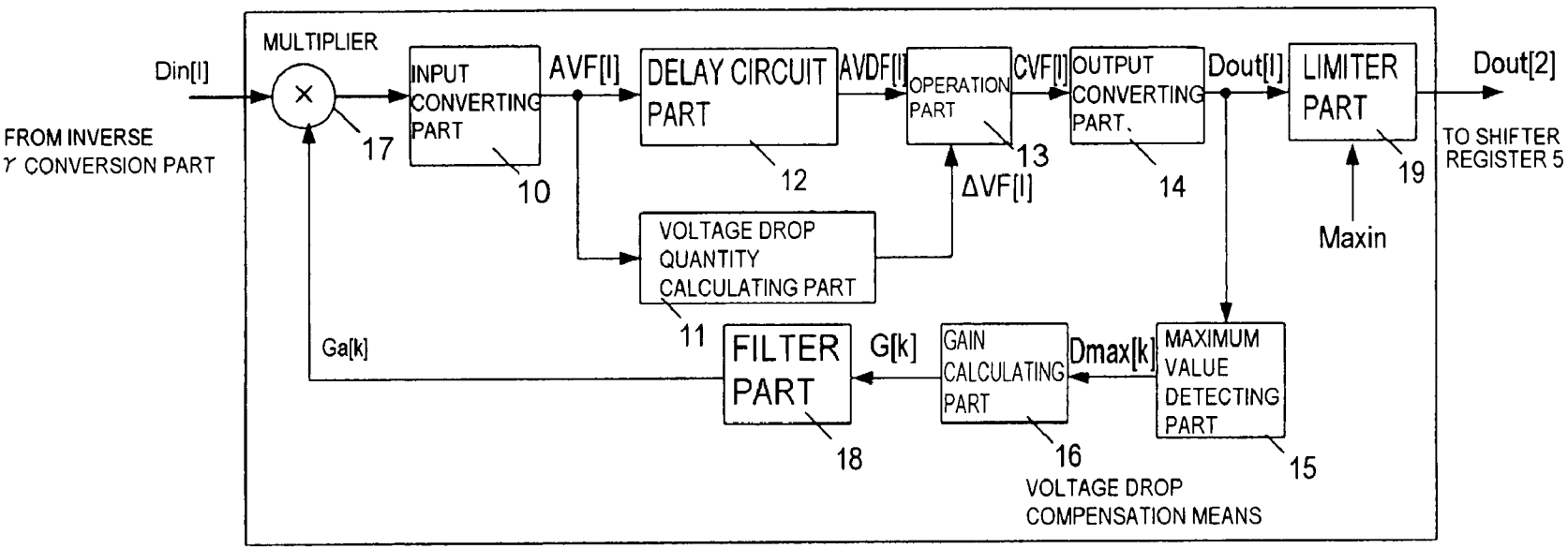
FIG. 13 is a block diagram schematically showing another voltage drop compensation means according to the third embodiment.

FIG. 13 is a block diagram schematically showing another voltage drop compensation means according to the third embodiment.

Referring to FIG. 13, to cope with the above-described problem, a filter part 18 is provided as a new part in order to take measures to restrain the variation of the gain by means of a filter (low-pass filter) for smoothing the variation of the gain between frames.

It is also possible to calculate another gain Ga[k] whose variation is restrained by a feedback filter which is shown below by way of example.

$$Ga[k]=a\times G[k]+(1-a)\times Ga[k-1], \quad \text{[Equation 12]}$$

where a is a coefficient of 0<a<1.

The image data Din[I] is multiplied by the gain Ga[k] calculated in this manner, whereby overflows can be prevented.

Incidentally, there are some cases where overflows cannot be strictly prevented by filtering the gain.

To completely prevent overflows, a limiter part 19 which completely limits the size of the corrected image data Dout[I] to a range below the input maximum value MAXin of the modulation means 8 is provided as shown in FIG. 13. With the limiter part 19, it is possible to completely prevent overflows.

Namely,

Dout2[I]=Dout[I] (when Dout[I]<MAXin), and

Dout2[I]=MAXin (when Dout[I]≧MAXin). [Equations 13]

When the output Dout[I] limited in this manner is supplied to the input of the shift register 5, greatly preferable modulation can be performed.

The present inventors has confirmed another problem in which when a scene change occurs in an image, a gain before filtering greatly varies, but, on the other hand, the gain is filtered to be restrained in variation, so that a rapid gain change cannot be performed.

Figure 14:
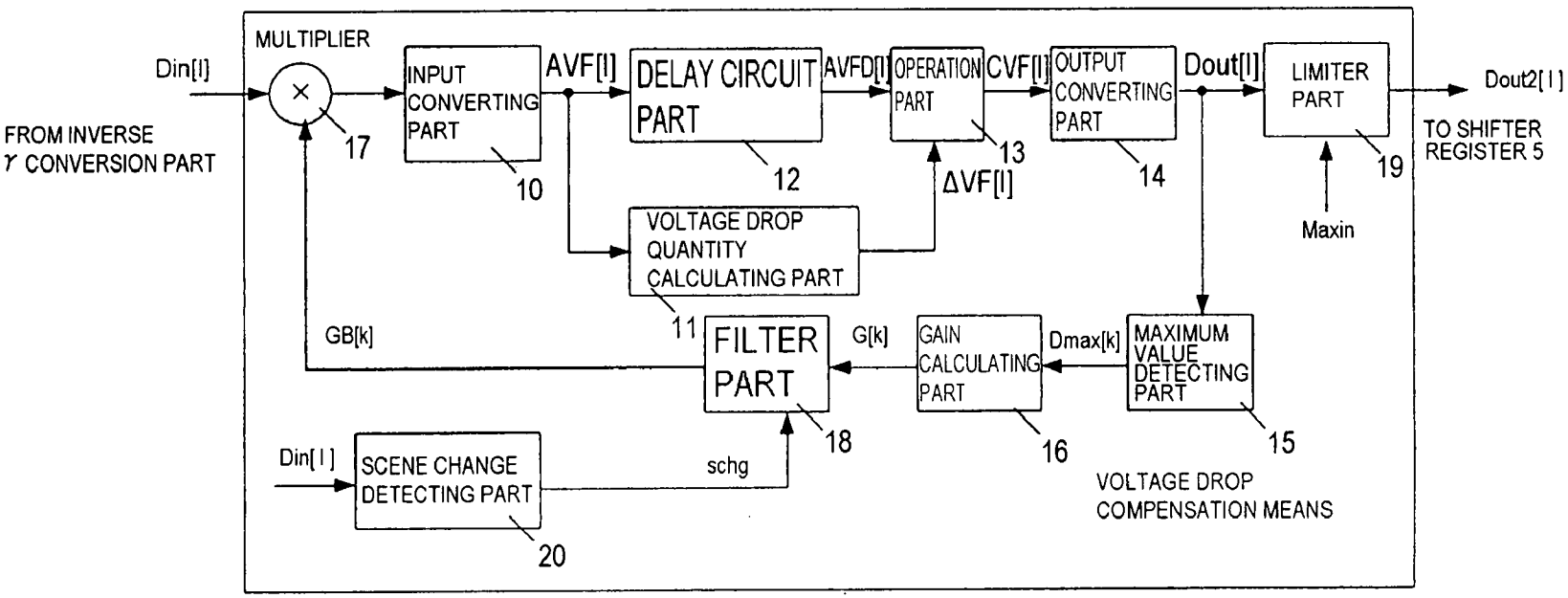
FIG. 14 is a block diagram schematically showing voltage drop compensation means according to the third embodiment.

FIG. 14 is a block diagram schematically showing another voltage drop compensation means according to the third embodiment.

Referring to FIG. 14, to cope with the above-described problem, there is provided a scene change detecting part 20 which checks the image data Din[I] and, if a scene changes, detects the scene change. The scene change detecting part 20 supplies a detection signal schg to the filter part 18.

Further, in the filter part 18 of FIG. 14, gain control is performed to switch gains in the following manner:

Gb[k]=G[k] (in the case where a scene change occurs), and $Gb[k]=a\times G[k]+(1-a)\times Gb[k-1]$ (in the case where no scene change occurs), where a is a coefficient of 0<a<1.

When gain control is performed in this manner, in the same scene, the variation of the gain can be restrained and a flicker-free image can be obtained. Greatly preferably, the gain can be varied rapidly when a scene change occurs.

Incidentally, the detection of a scene change can be easily implemented, for example by a method of calculating the difference between APLs (average picture levels) in each frame and, if the difference is greater than a certain threshold, determines that a scene change has occurred.

By adopting the above-described construction, it is possible to suitably prevent the above-described overflows, and, far more preferably, it is possible to suitably perform compensation of voltage drops.

Fourth Embodiment

In the description of the third embodiment, reference has been made to the voltage drop compensation means which adopts measures against overflows occurring during the compensation of voltage drops.

Figure 15:
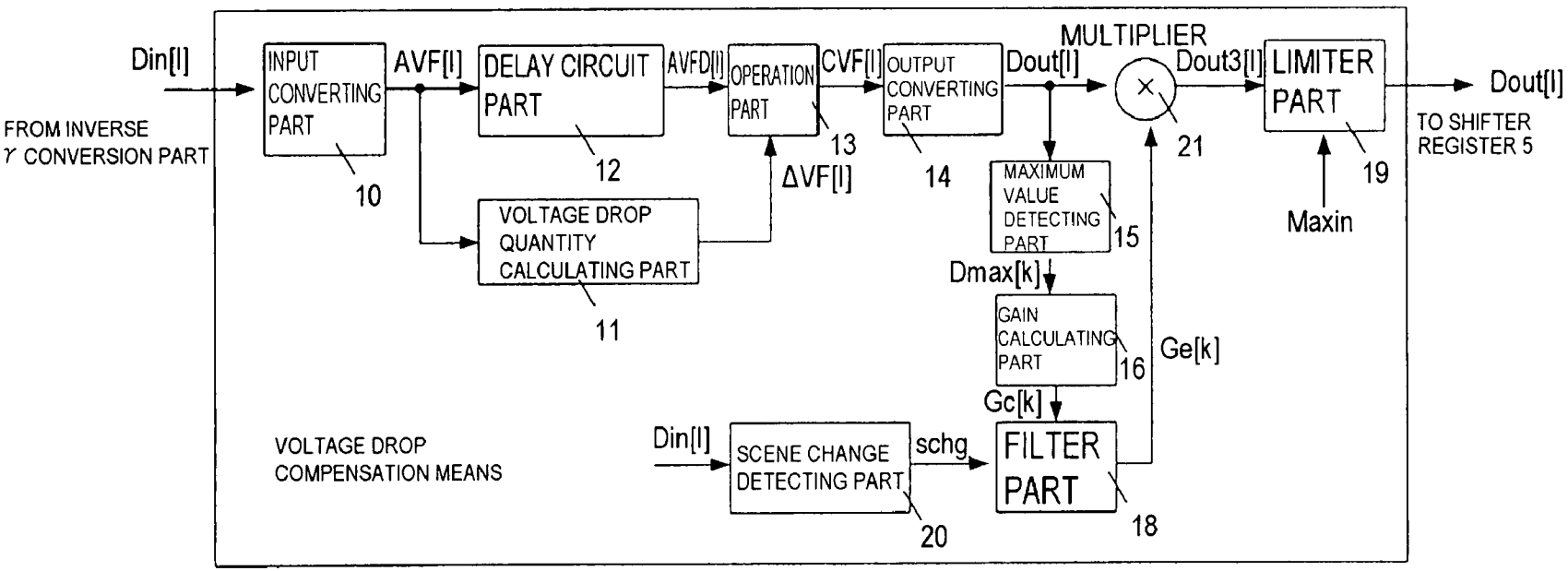
FIG. 15 is a block diagram schematically showing another voltage drop compensation means according to a fourth embodiment.
Figure 16:
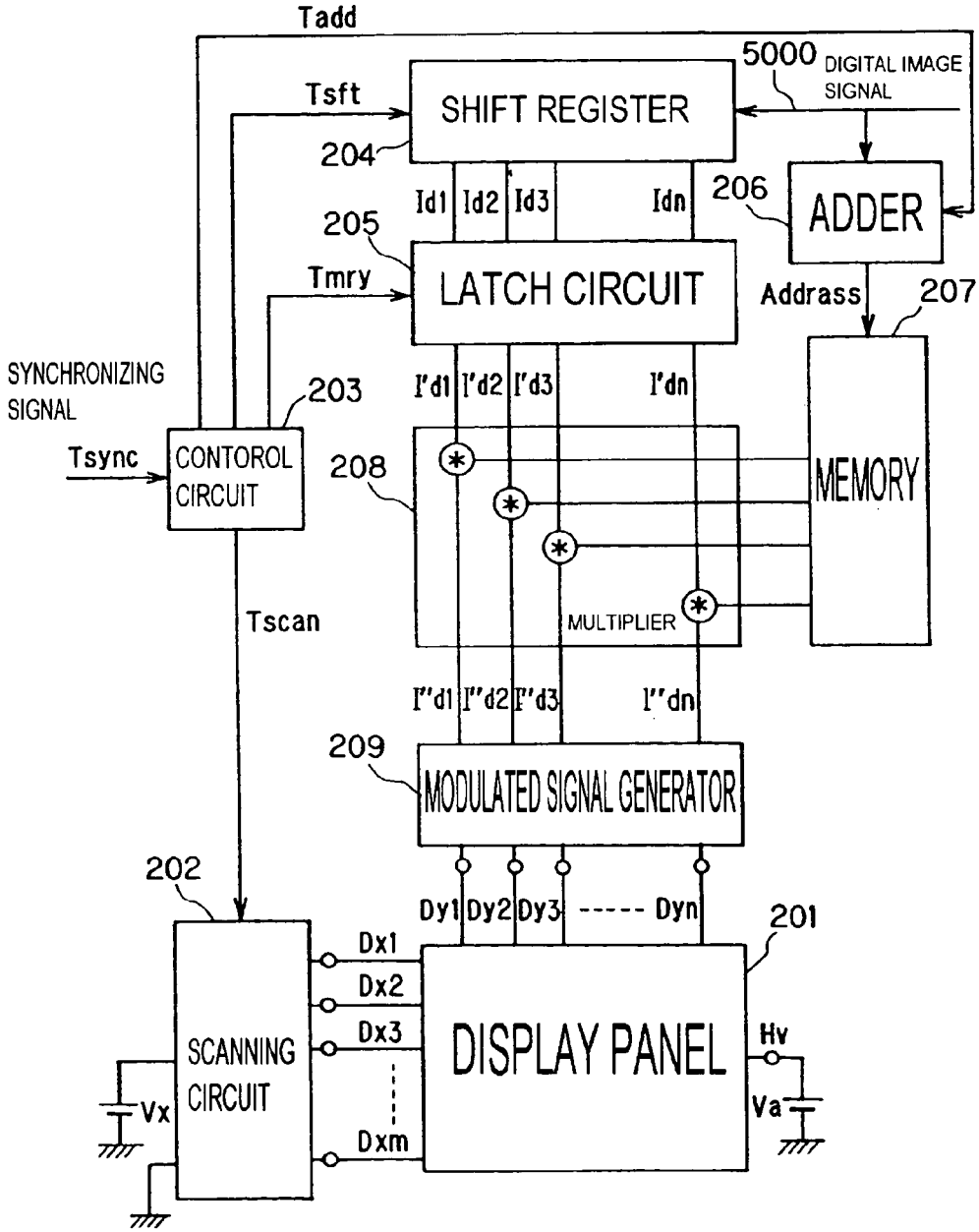
FIG. 16 is a block diagram schematically showing the construction of a related art image display apparatus.
Figure 17:
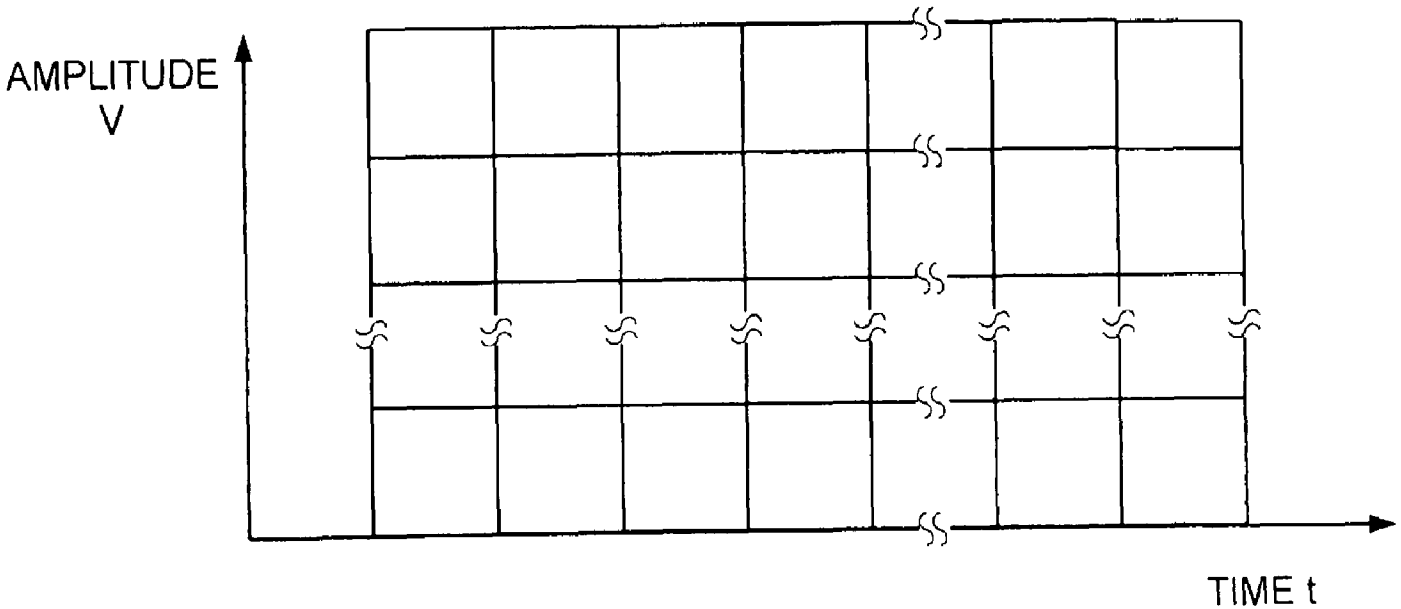
FIG. 17 is a view for describing a modulation method using both modulation of pulses in the voltage direction and modulation of pulses in the time direction.

However, the construction shown in FIG. 15 may also be adopted in the sense of preventing overflows.

Namely, in the third embodiment, overflows are prevented by using input data which is previously reduced in size, but in the fourth embodiment, input data are not previously reduced in size, and the size of data is reduced immediately before the data is inputted to the modulation means 8.

In the fourth embodiment, as shown in FIG. 15, the maximum value Dmax[k] of the k-th frame of the corrected image data Dout[I] is detected (the maximum value detecting part 15). Further, a gain Gc[k] is calculated in the following manner so that the maximum value Dmax[k] is contained in the input maximum value MAXin of the modulation means 8 (the gain calculating part 16).

$$Gc[k]=\mathrm{MAXin}/\mathrm{Dmax}[k] \quad \text{[Equation 15]}$$

where Gc[k] is the gain of the k-th frame.

In addition, as to the calculated gain Gc[k], measures to restrain the variation of the gain are taken by means of a filter (low-pass filter) for smoothing the variation of the gain between frames.

For example, another gain Gd[k] whose variation is restrained by a feedback filter which is shown below is calculated (the filter part 18).

$$Gd[k]=a\times Gc[k]+(1-a)\times Gd[k-1] \quad \text{[Equation 16]}$$

where a is a coefficient of 0<a<1.

In addition, the scene change detecting part 20 is provided for the purpose of rapidly varying the gain when a scene changes, and supplies to the filter part 18 the signal schg indicative of whether a scene change has occurred.

Further, in the filter part 18 of FIG. 15, gain control is performed to switch gains in the following manner:

$$Ge[k]=Gc[k] \text{ (in the case where a scene change occurs), and}$$

$$Ge[k]=a\times G[k]+(1-a)\times Ge[k-1] \text{ (in the case where no scene change occurs),} \quad \text{[Equations 17]}$$

where a is a coefficient of $0<a<1$.

The image data Din[I] is multiplied by the gain Ge[k] calculated in this manner, whereby overflows can be prevented (a multiplier 21).

Furthermore, the corrected image data Dout [I] of the (k+1)-th frame is multiplied by the calculated gain Ge[k], thereby calculating corrected image data Dout3[I] which can take a limited range.

$$Dout3[I]=Ge[k]\times Dout[I]. \quad \text{[Equation 18]}$$

Further, in the fourth embodiment as well, to completely prevent overflows due to filtering, the limiter part 19 which completely limits the size of the corrected image data Dout[I] to a range below the input maximum value MAXin of the modulation means 8 is provided as shown in FIG. 15. With the limiter part 19, it is possible to completely prevent overflows.

Namely, $$Dout4[I]=Dout3[I] \text{ (when } Dout3[I]<MAXin\text{), and}$$

$$Dout4[I]=MAXin \text{ (when } Dout3[I]\geqq MAXin\text{).} \quad \text{[Equations 19]}$$

When the output Dout4[I] limited in this manner is supplied to the input of the shift register 5, greatly preferable modulation can be performed.

By adopting the above-described construction, it is possible to suitably prevent the above-described overflows, and, far more preferably, it is possible to suitably perform compensation of voltage drops.

As described hereinabove, according to the invention, it is possible to obtain preferable display images by suitably compensating for the influence of voltage drops by employing modulation which uses both modulation of pulses in the voltage direction and modulation of pulses in the time direction.

The invention claimed:

1. An image display apparatus comprising:

electron-emitting devices driven in a matrix by a plurality of row wirings and column wirings;

a scanning circuit for sequentially selecting and scanning the row wirings;

a modulation circuit generating a modulated signal by modulating both a pulse width and a voltage amplitude, with the modulated signal being applied to the column wirings; and a voltage drop compensation circuit for calculating corrected image data for reducing an influence of voltage drops due to at least resistance components of the row wirings, with respect to image data, wherein the voltage drop compensation circuit includes;

an effective voltage calculating circuit for finding an effective voltage value on the basis of the image data, the effective voltage value being a value obtained by averaging in a time direction a voltage amplitude value of the modulated signal corresponding to the image data for one horizontal scanning period; and a compensation value calculating circuit for calculating a compensation value for reducing an influence of voltage drops due to at least resistance components of the row wirings, with respect to the effective voltage value, wherein the modulation circuit outputs a modulated signal on the basis of the corrected image data, wherein a pulse waveform of the modulated signal has a plurality of voltage amplitude values or one voltage amplitude value, wherein the modulation circuit increases a time width of a pulse waveform of the modulated signal by one unit time or a voltage amplitude value of a portion of the pulse waveform of the modulated signal by one unit voltage, when input data of the modulation circuit is increased by one unit, and wherein the voltage drop compensation circuit calculates the corrected image data with respect to image data obtained by multiplying the image data by a gain of greater than 0 but not greater than 1, so that the corrected image data is contained in an input range of the modulation circuit.

2. An image display apparatus according to claim 1, wherein the modulation circuit outputs the modulated signal on the basis of limited range-corrected image data obtained by multiplying the corrected image data by a gain of greater than 0 but not greater than 1, so that the limited range-corrected image data is contained in an input range of the modulation circuit.

3. An image display apparatus comprising:

electron-emitting devices driven in a matrix by a plurality of row wirings and column wirings;

a scanning circuit for sequentially selecting and scanning the row wirings;

a modulation circuit generating a modulated signal by modulating both a pulse width and a voltage amplitude, with the modulated signal being applied to the column wirings; and a voltage drop compensation circuit for calculating corrected image data for reducing an influence of voltage drops due to at least resistance components of the row wirings, with respect to image data, wherein the voltage drop compensation circuit includes;

an effective voltage calculating circuit for finding an effective voltage value on the basis of the image data, the effective voltage value being a value obtained by averaging in a time direction a voltage amplitude value of the modulated signal corresponding to the image data for one horizontal scanning period; and a compensation value calculating circuit for calculating a compensation value for reducing an influence of voltage drops due to at least resistance components of the row wirings, with respect to the effective voltage value, wherein the modulation circuit outputs a modulated signal on the basis of the corrected image data, wherein a pulse waveform of the modulated signal has a plurality of voltage amplitude values or one voltage amplitude value, and wherein the modulation circuit outputs the modulated signal on the basis of limited range-corrected image data obtained by multiplying the corrected image data by a gain of greater than 0 but not greater than 1, so that the limited range-corrected image data is contained in an input range of the modulation circuit.

4. An image display apparatus according to claim 3, wherein the modulation circuit increases a time width of a pulse waveform of the modulated signal by one unit time or a voltage amplitude value of a portion of the pulse waveform of the modulated signal by one unit voltage, when input data of the modulation circuit is increased by one unit.

5. An image display apparatus according to claim 3, wherein the voltage drop compensation circuit calculates the corrected image data with respect to image data obtained by multiplying the image data by a gain of greater than 0 but not greater than 1, so that the corrected image is contained in an input range of the modulation circuit.

* * * * *